US007965974B2

(12) United States Patent
Torimaru et al.

(10) Patent No.: US 7,965,974 B2
(45) Date of Patent: Jun. 21, 2011

(54) IMAGE FORMING APPARATUS

(75) Inventors: Satoru Torimaru, Kagoshima (JP); Atsuyuki Kitamura, Kanagawa (JP); Masahiro Sato, Kanagawa (JP); Atsushi Ogihara, Kanagawa (JP); Junichi Murakami, Kanagawa (JP); Tetsuji Okamoto, Kanagwa (JP); Shuichi Nishide, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 12/506,500

(22) Filed: Jul. 21, 2009

(65) Prior Publication Data

US 2010/0183339 A1 Jul. 22, 2010

(30) Foreign Application Priority Data

Jan. 19, 2009 (JP) ..... 2009-008449

(51) Int. Cl.
*G03G 15/00* (2006.01)

(52) U.S. Cl. ..... 399/401; 399/76; 399/227; 399/316

(58) Field of Classification Search ..... 399/53, 399/76, 222–223, 225–227, 297–298, 302, 399/316, 388, 397, 400, 401
See application file for complete search history.

(56) References Cited

U.S. PATENT DOCUMENTS

2002/0076242 A1 * 6/2002 Arcaro et al. ..... 399/301

FOREIGN PATENT DOCUMENTS

| | | |
|---|---|---|
| JP | 63-296067 | 12/1988 |
| JP | 05-188728 | 7/1993 |
| JP | 2006-349701 | 12/2006 |

* cited by examiner

*Primary Examiner* — David P Porta
*Assistant Examiner* — Benjamin Schmitt
(74) *Attorney, Agent, or Firm* — Fildes & Outland, P.C.

(57) ABSTRACT

An image forming apparatus includes: an image carrier that carries an electrostatic latent image; plural developing devices that store respective developers of different colors and visualize the electrostatic latent image with the developers; a developing device switching mechanism that switches among the developing devices; a transfer unit that transfers a developer image visualized by the one of the developing devices to a recording medium; a fixing device that fixes the developer image transferred by the transfer unit onto the recording medium; a first transporter that transports in a first direction the recording medium with the developer image fixed thereon; a second transporter that transports in a second direction the recording medium with the developer image fixed thereon; and a transporter switching mechanism that switches between the first transporter and the second transporter in conjunction with an operation of the developing device switching mechanism for switching among the developing devices.

7 Claims, 17 Drawing Sheets

10

32
44
46K
42Y
46Y
42K
46C
42C
46M
42M
K
Y
C
M
40
50
48
52
24
26
64
66
68
70
72
74
76
78
80
82
84
86
88
90
92

IMAGE FORMING APPARATUS

CROSS-REFERENCE TO RELATED APPLICATIONS

This application is based on and claims priority under 35 USC 119 from Japanese Patent Application No. 2009-008449 filed Jan. 19, 2009.

BACKGROUND

Technical Field

The present invention relates to an image forming apparatus.

SUMMARY

According to an aspect of the invention, there is provided an image forming apparatus including: an image carrier that carries an electrostatic latent image; plural developing devices that store respective developers of different colors and visualize the electrostatic latent image with the developers; a developing device switching mechanism that switches among the developing devices to allow one of the developing devices to visualize the electrostatic latent image carried by the image carrier; a transfer unit that transfers a developer image visualized by the one of the developing devices to a recording medium; a fixing device that fixes the developer image transferred by the transfer unit onto the recording medium; a first transporter that transports in a first direction the recording medium with the developer image fixed thereon by the fixing device; a second transporter that transports in a second direction the recording medium with the developer image fixed thereon by the fixing device; and a transporter switching mechanism that switches between the first transporter and the second transporter in conjunction with an operation of the developing device switching mechanism for switching among the developing devices.

BRIEF DESCRIPTION OF THE DRAWINGS

Exemplary embodiments of the present invention will be described in detail based on the following figures, wherein:

FIGS. 2A and 2B are views illustrating a transport path switching mechanism and its periphery, wherein FIG. 2A is a side view, and FIG. 2B is a front view;

FIGS. 3A to 3H are schematic side views illustrating the operation of the transport path switching mechanism, wherein FIGS. 3A to 3D are side views illustrating a rotational state of a rotary development device, and FIGS. 3E to 3H are side views illustrating a state of the transport path switching mechanism corresponding to the state of the rotary development device shown in FIGS. 3A to 3D;

FIGS. 9A and 9B are views illustrating a driving system for driving respective developing rollers, wherein FIG. 9A is a side view of the driving system, and FIG. 9B is a front view of the driving system;

FIGS. 10A and 10B are views illustrating a switching mechanism, wherein FIG. 10A is a side view of the switching mechanism, and FIG. 10B is an enlarged front view of the switching mechanism;

DETAILED DESCRIPTION

Hereinafter, a first exemplary embodiment of the present invention will be described with reference to the accompanying drawings.

Figure 1:
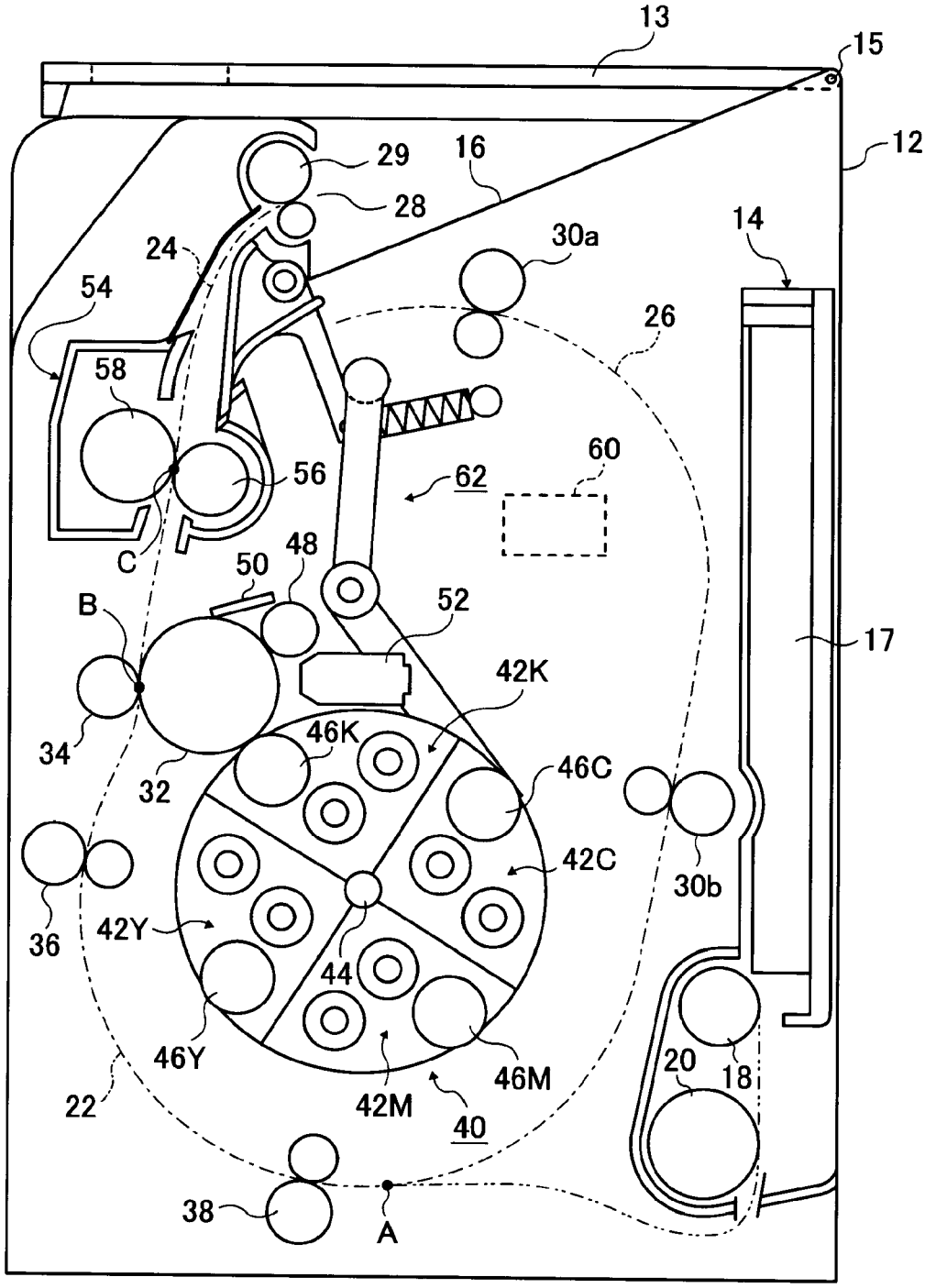
FIG. 1 is a schematic side view of an image forming apparatus according to a first exemplary embodiment of the invention.

FIG. 1 illustrates schematically an image forming apparatus 10 according to the first exemplary embodiment of the invention. The image forming apparatus 10 includes an image forming apparatus chassis 12. An opening and closing portion 13 is provided on an upper portion of the image forming apparatus chassis 12, and a paper feed unit 14 is provided, for example, on the front side of the image forming apparatus chassis 12 (the right side in FIG. 1). The opening and closing portion 13 is configured to be opened and closed about a shaft 15 and to form an ejector 16 (see FIG. 4 or the like) for ejecting a recording medium on an upper portion of the image forming apparatus chassis 12 when the opening and closing portion 13 is opened.

Figure 4:
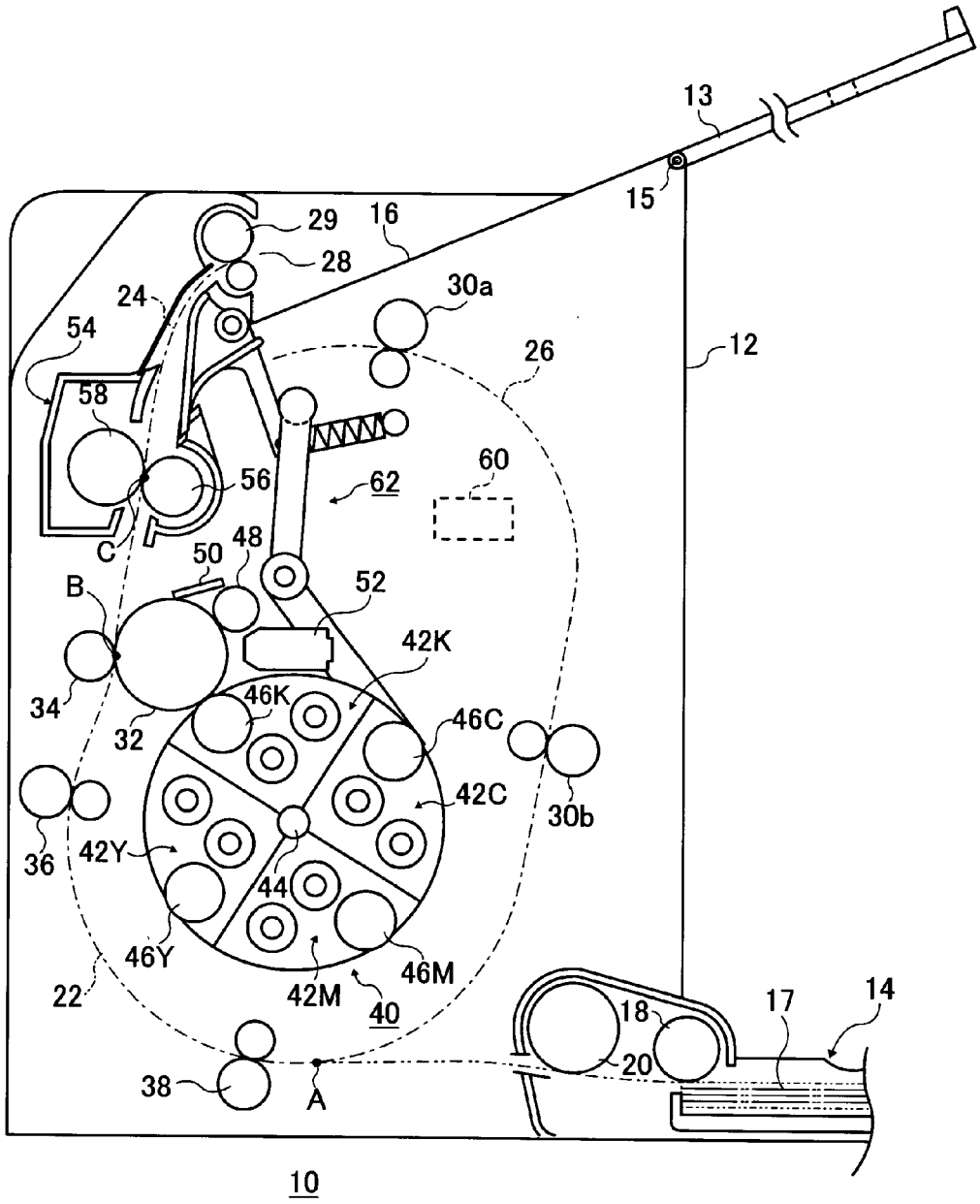
FIG. 4 is a side view illustrating a state of the image forming apparatus in black-and-white printing.

The paper feed unit 14 is openable and closable about a shaft (not shown) provided on a lower portion thereof, and includes a paper cassette 17 for storing the recording media such as paper when opened (see FIG. 4 or the like). The paper cassette 17 is designed to be extensible, and the maximum size of the recording medium capable of being stored therein is, for example, A4 size paper. Also, the paper cassette 17 is provided with a pickup roller 18 for drawing the recording medium from the paper cassette 17.

The recording media drawn from the paper cassette 17 by the pickup roller 18 are separated by a feed roller 20 and a separation member (not shown) to be transported one by one to a main transport path 22. The main transport path 22 serves as a recording medium passage from the pickup roller 18 to a fixing device 54 to be described later. Also, the main transport path 22 is selectively connected to an ejecting transport path 24 or a circulating transport path 26 on the downstream side of the fixing device 54 by a transport path switching mechanism 62 to be described later with reference to FIGS. 2A to 3H, and the like.

The ejecting transport path 24 serves as a recording medium passage from the fixing device 54 to an ejection port 28. Also, an eject roller 29 is provided in the vicinity of the ejection port 28 of the main transport path 22. The circulating transport path 26 serves as a recording medium passage from the fixing device 54 to a merging point A into the main transport path 22, and includes transport rollers 30*a* and 30*b* for transporting the recording medium to form a circulating path for circulating the recording medium in combination with the main transport path 22.

An image carrier 32 and a transfer roller 34 having an elastic surface are provided on the upstream side of the fixing device 54 on the main transport path 22. The contact portion between the image carrier 32 and the transfer roller 34 corresponds to a transfer position B where a developer image carried by the image carrier 32 is transferred to the recording medium. A registration roller 36 is provided on the upstream side of the image carrier 32 and the transfer roller 34, and a transport roller 38 for transporting the recording medium is provided on the upstream side of the registration roller 36.

Thus, the recording medium drawn from the paper cassette 17 of the paper feed unit 14 by the pickup roller 18 is guided to the main transport path 22 to be transported to the transport roller 38. The recording medium is temporarily stopped by the registration roller 36 to pass between the image carrier 32 and the transfer roller 34 with a predetermined timing, where for example, a black developer image is transferred to the recording medium. The transferred black developer image is fixed onto the recording medium by the fixing device 54, and the recording medium is ejected from the ejection port 28 to the ejector 16 by the eject roller 29.

In the case where a developer image of the color other than black is transferred and fixed, however, the main transport path 22 is connected to the circulating transport path 26 by the transport path switching mechanism 62 to allow the recording medium to circulate through the circulating transport path 26.

A rotary development device 40 is provided, for example, at a substantially central lower portion in the image forming apparatus chassis 12. The rotary development device 40 includes a developing device 42Y for storing a yellow developer, a developing device 42M for storing a magenta developer, a developing device 42C for storing a cyan developer, and a developing device 42K for storing a black developer, and is configured to rotate (clockwise in FIG. 1) about a shaft 44. The developing devices 42Y, 42M, 42C, and 42K have respective developing rollers 46Y, 46M, 46C, and 46K, and sequentially visualize an electrostatic latent image carried by the image carrier 32, with the respective developers at a predetermined developing position.

In front of the image carrier 32, there is provided an charging device 48 composed of, for example, a charging roller, for uniformly charging the image carrier 32. In other words, a developing bias is applied to the image carrier 32. Also, an image carrier cleaner 50 abuts on the image carrier 32 on the upstream side of the charging device 48 in the rotation direction of the image carrier 32. The image carrier cleaner 50 scrapes off the developer remaining on the image carrier 32 after transfer.

Between the rotary development device 40 and the charging device 48, there is provided an exposure device 52 for writing an electrostatic latent image on the image carrier 32 charged by the charging device 48, by means of light rays, such as laser beams. Also, the transfer roller 34 described above is disposed at the rear of the image carrier 32. The transfer roller 34 sequentially superimposes and transfers the developer images visualized by the developing devices 42Y, 42M, 42C, and 42K onto the recording medium at the transfer position B.

The fixing device 54, provided downstream of the transfer position B, includes a heating roller 56 and a pressure roller 58, and transports the recording medium with the developer image transferred by the image carrier 32 and the transfer roller 34 while holding the recording medium using a contact portion (nip portion: fixing position C) between the heating roller 56 and the pressure roller 58 to fix the developer image onto the recording medium by heating and pressing the developer image.

In the image forming apparatus chassis 12, a controller 60 for controlling respective components composing the image forming apparatus 10 is also provided.

Next, the transport path switching mechanism 62 will be described in detail.

Figure 2B:
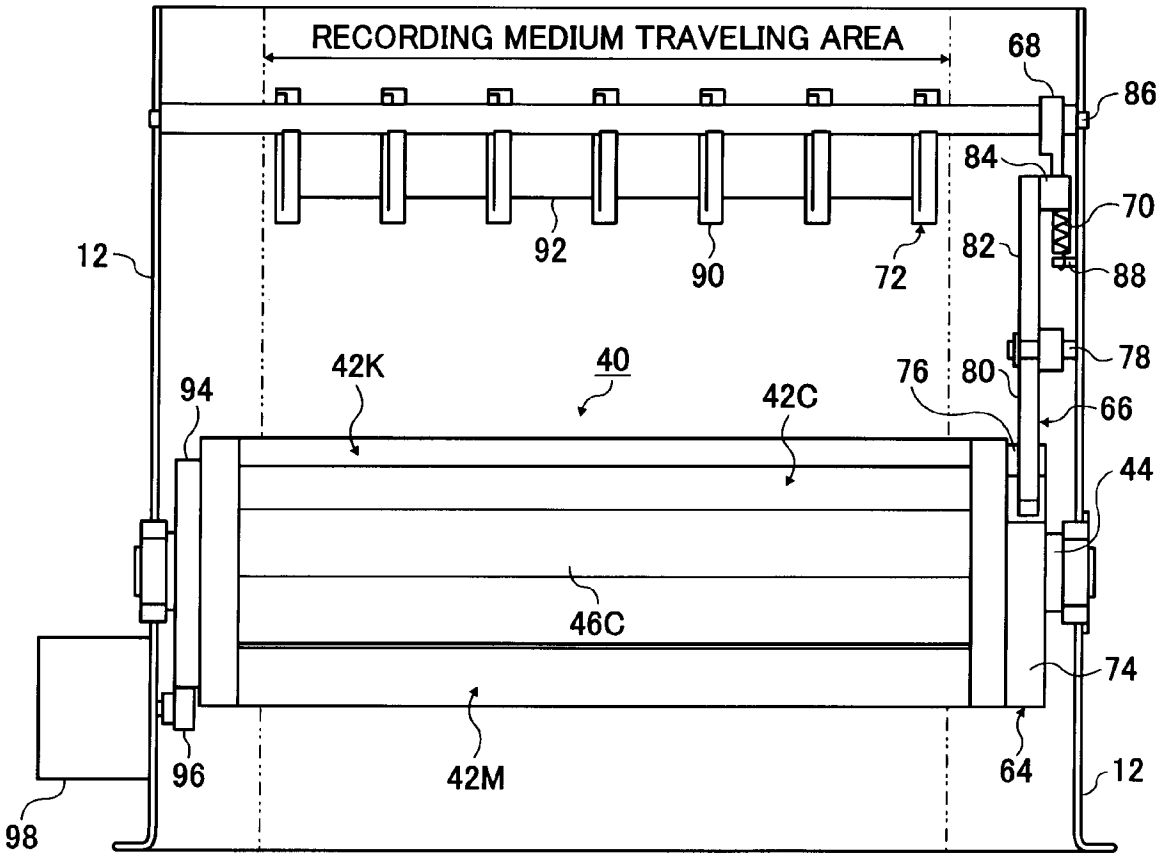
Figure 2A:
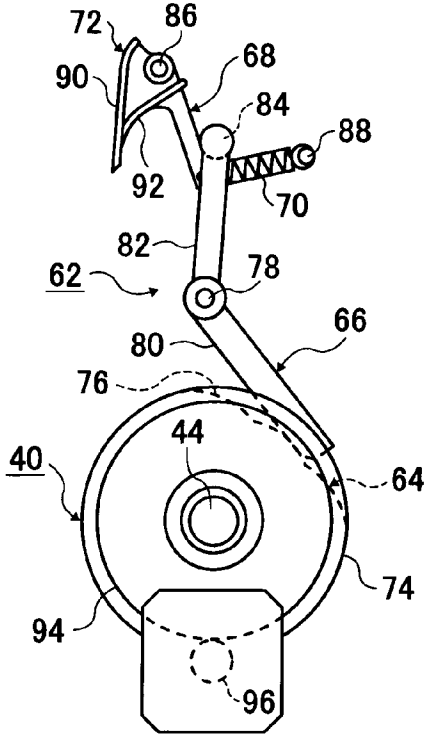

FIGS. 2A and 2B are views illustrating the transport path switching mechanism 62 and its periphery. FIG. 2A is a side view, and FIG. 2B is a front view.

The transport path switching mechanism 62 includes a cam 64, a first displacement member 66, a second displacement member 68, an elastic member 70, and a claw member 72.

The cam 64 is provided on the axial end of the rotary development device 40, and is configured to rotate about the shaft 44 serving as a rotary shaft of the rotary development device 40 together with the rotary development device 40. Also, the cam 64 includes, as shown in FIG. 2A, a cylindrical portion 74 having a uniform distance from the shaft 44 to the outer peripheral surface thereof, and a displacement forming portion 76 with a distance from the shaft 44 to the outer peripheral surface thereof shorter than that of the cylindrical portion 74.

The first displacement member 66 is rotatable about a shaft 78 fixed to the image forming apparatus chassis 12, and includes two arm portions 80 and 82 extending in different directions from the shaft 78. The arm portion 80 is brought into slidable contact with an outer peripheral surface of the cam 64. On the end of the arm portion 82 on the opposite side of the shaft 78, a protrusion 84 protruding in the direction parallel to the shaft 78 is provided so that the arm portion 82 is brought into slidable contact with the second displacement member 68.

The second displacement member 68 has one end fixed to a shaft 86 rotatably fixed to the image forming apparatus chassis 12, and is rotatable about the shaft 86. Also, the second displacement member 68 has the other end attached to one end of the elastic member 70.

Examples of the elastic member 70 include a spring. The elastic member 70, having one end attached to one end of the second displacement member 68, and the other end attached to a protruding portion 88 protruding from the image forming apparatus chassis 12, urges the end (the opposite side of the shaft 86) of the second displacement member 68 in a direction to approach the protruding portion 88.

The claw member 72 includes a first guide portion 90 composed of, for example, plural claws, and a second guide portion 92 in a recording medium traveling area shown in FIG. 2B, and is fixed to the shaft 86 to be displaced in conjunction with displacement of the second displacement member 68. The first guide portion 90 is adapted to form a part of the ejecting transport path 24, and the second guide portion 92 is adapted to form a part of the circulating transport path 26.

A gear 94 to rotate about the shaft 44 is fixed to the rotary development device 40 on the opposite side of the cam 64. More specifically, when the rotary development device 40 receives a driving force of a driving source 98, such as a motor, through the gear 94 and a gear 96 to rotate, the cam 64 rotates.

Next, the operation of the transport path switching mechanism 62 will be described.

FIGS. 3A to 3H are schematic side views illustrating the operation of the transport path switching mechanism 62. FIGS. 3A to 3D are side views illustrating a rotational state of the rotary development device 40, and FIGS. 3E to 3H are side views illustrating a state of the transport path switching mechanism 62 corresponding to a state of the rotary development device 40 shown in FIGS. 3A to 3D.

Figures 3A, 3B, 3C, 3D, 3E, 3F, 3G, 3H:
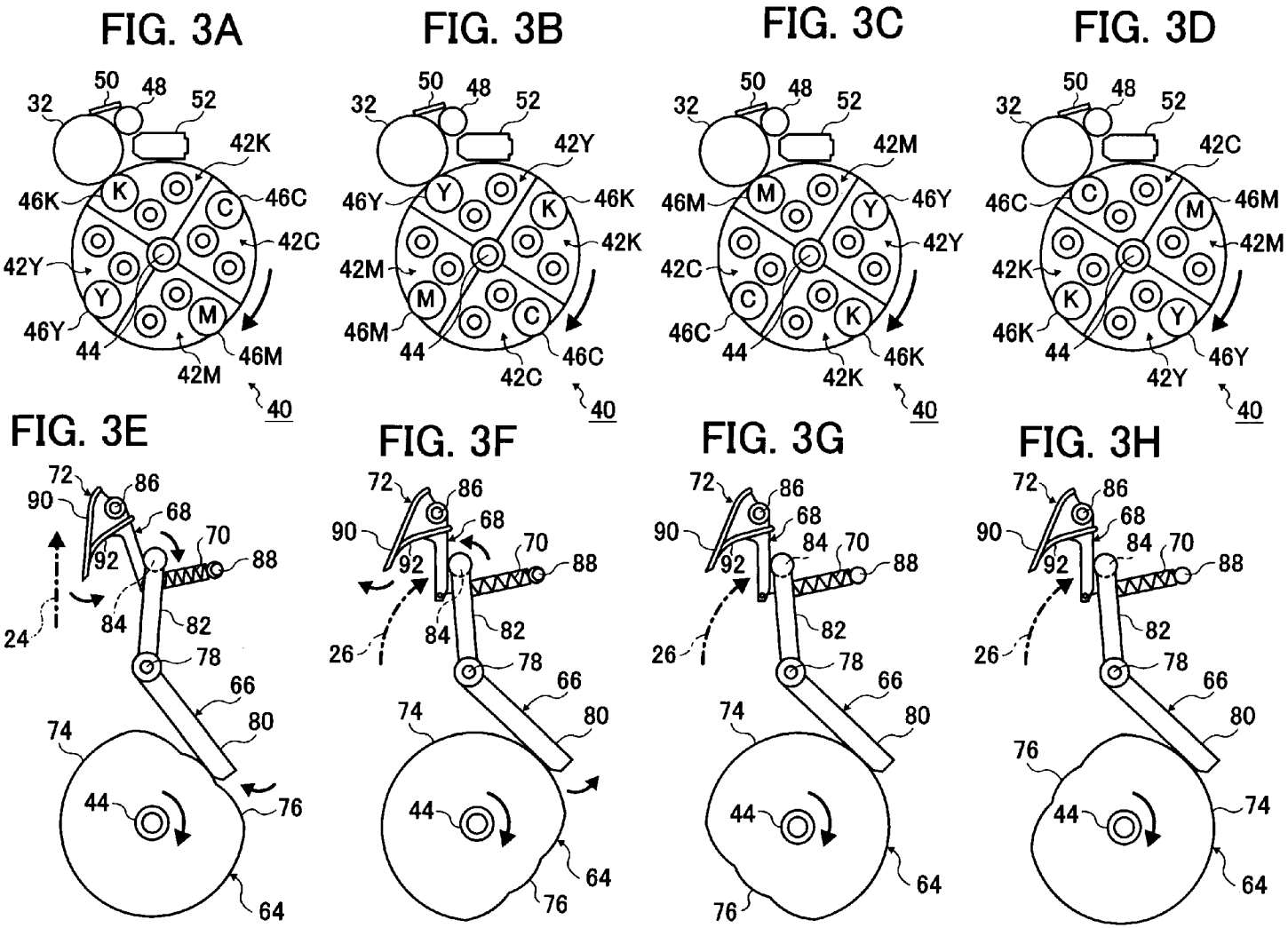

When the rotary development device 40 rotates so that the developing roller 46K is opposed to the image carrier 32 at the developing position as shown in FIG. 3A, the cam 64 rotates to bring the displacement forming portion 76 of the cam 64 into contact with the arm portion 80 of the first displacement member 66 as shown in FIG. 3E. In that case, since the protrusion 84 of the arm portion 82 is displaced about the shaft 78 in a direction to approach the protruding portion 88, the end of the second displacement member 68 on the opposite side of the shaft 86 approaches the protruding portion 88, and the claw member 72 is displaced (moved counterclockwise in FIG. 3) in the direction where the first guide portion 90 forms a part of the ejecting transport path 24.

When the rotary development device 40 rotates so that the developing roller 46Y is opposed to the image carrier 32 at the developing position as shown in FIG. 3B, the cam 64 rotates to bring the cylindrical portion 74 of the cam 64 into contact with the arm portion 80 of the first displacement member 66 as shown in FIG. 3F. In that case, since the protrusion 84 of the arm portion 82 is displaced about the shaft 78 in a direction to be separated from the protruding portion 88 against the bias of the elastic member 70, the end of the second displacement member 68 on the opposite side of the shaft 86 is displaced in a direction to be separated from the protruding portion 88, and the claw member 72 is displaced (moved clockwise in FIG. 3) in the direction where the second guide portion 92 forms a part of the circulating transport path 26.

Even when the rotary development device 40 rotates so that the developing roller 46M is opposed to the image carrier 32 at the developing position as shown in FIG. 3C, the cylindrical portion 74 of the cam 64 is in contact with the arm portion 80 of the first displacement member 66 as shown in FIG. 3G. That is to say, even when the rotary development device 40 rotates so that the developing roller 46M is opposed to the image carrier 32 at the developing position, the first displacement member 66 is not displaced, and therefore the second displacement member 68 is not displaced, so that the state in which the second guide portion 92 forms a part of the circulating transport path 26 is maintained.

Even when the rotary development device 40 rotates so that the developing roller 46C is opposed to the image carrier 32 at the developing position as shown in FIG. 3D, the cylindrical portion 74 of the cam 64 is in contact with the arm portion 80 of the first displacement member 66 as shown in FIG. 3H. That is to say, even when the rotary development device 40 rotates so that the developing roller 46C is opposed to the image carrier 32 at the developing position, the first displacement member 66 is not displaced, and therefore the second displacement member 68 is not displaced, so that the state in which the second guide portion 92 forms a part of the circulating transport path 26 is maintained.

Next, the entire operation (printing in black and white) of the image forming apparatus 10 will be described.

FIG. 4 is a side view illustrating a state of the image forming apparatus 10 in black-and-white printing.

Figure 5:
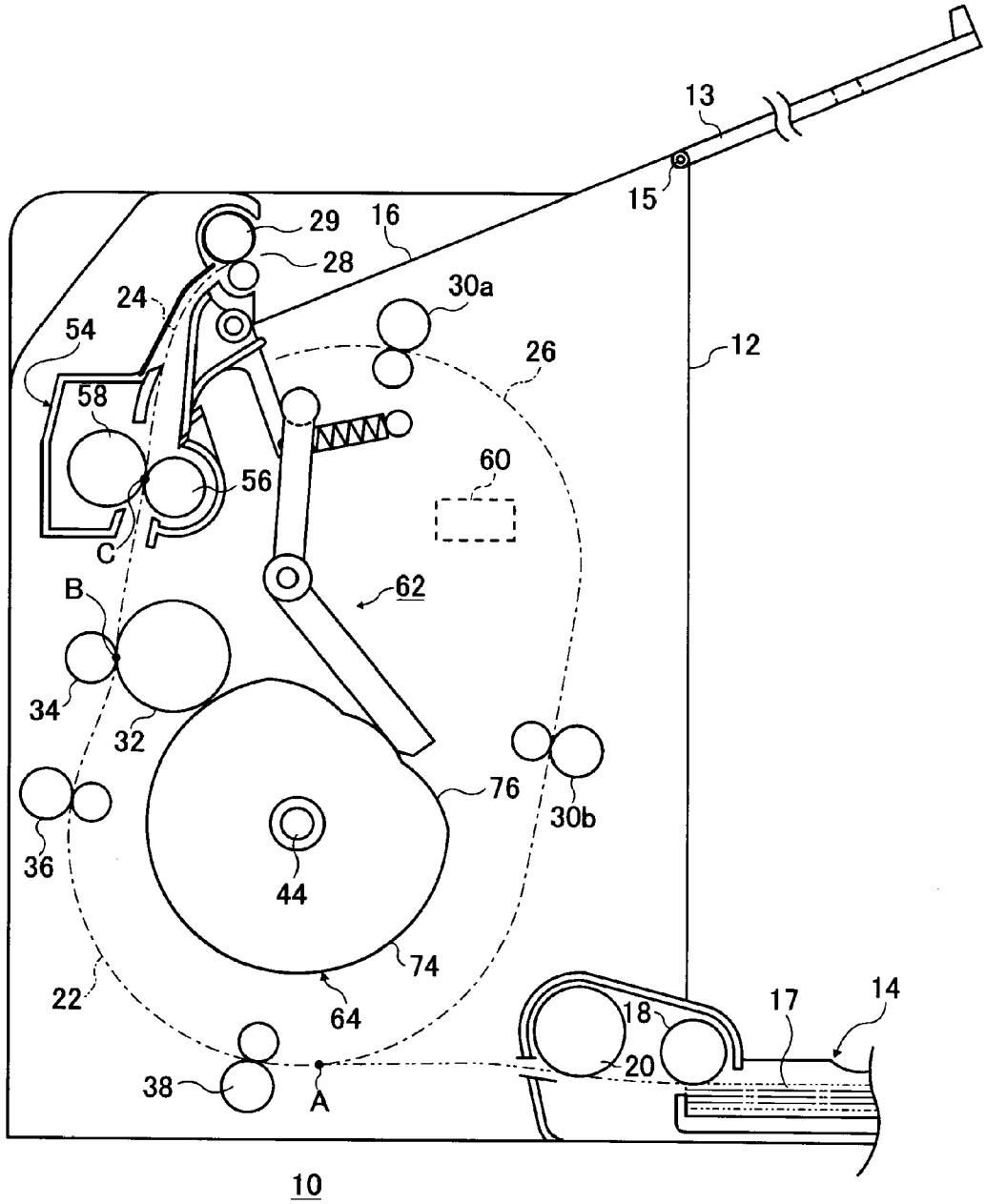
FIG. 5 is a side view illustrating the relationship between the transport path switching mechanism for the image forming apparatus shown in FIG. 4, and an ejecting transport path and a main transport path.

FIG. 5 is a side view illustrating the relationship between the transport path switching mechanism 62 for the image forming apparatus 10 shown in FIG. 4, and the ejecting transport path 24 and the main transport path 22.

As shown in FIG. 4, in the case where black-and-white printing is performed on, for example, an A4 size recording medium, the opening and closing portion 13 is opened by, for example, a user to thereby form the ejector 16 on an upper portion of the image forming apparatus chassis 12, and then the paper feed unit 14 is opened by, for example, a user to store recording media in the paper cassette 17, thereby allowing the image forming apparatus 10 to perform a printing operation.

When an image forming signal corresponding to black-and-white printing is transmitted to the image forming apparatus 10, the image carrier 32 is uniformly charged by the charging device 48, and then a light beam corresponding to a black image is emitted from the exposure device 52 to the charged image carrier 32 based on the image signal. The surface of the image carrier 32 is exposed to the light beam emitted from the exposure device 52, so that an electrostatic latent image is formed thereon. In the case of the black-and-white printing, the controller 60 rotates the rotary development device 40 so that the developing roller 46K of the developing device 42K is opposed to the image carrier 32, and applies a predetermined voltage (developing bias) to the developing roller 46K.

When the rotary development device 40 rotates so that the developing roller 46K of the developing device 42K is opposed to the image carrier 32, the cam 64 rotates to bring the displacement forming portion 76 into contact with the arm portion 80 as shown in FIGS. 3E and 5 and displace the first displacement member 66 and the second displacement member 68, so that the main transport path 22 is connected to the ejecting transport path 24.

The electrostatic latent image carried by the image carrier 32 is developed with a black developer supplied to the developing roller 46K of the developing device 42K to be transferred to the recording medium supplied from the paper feed unit 14 through the main transport path 22. The developer remaining on the image carrier 32 is scraped and recovered by the image carrier cleaner 50. The recording medium with the black developer image transferred thereto is guided to the fixing device 54, at which the black developer image is fixed onto the recording medium by the heating roller 56 and the pressure roller 58.

The recording medium with the black developer image fixed thereon is guided to the ejecting transport path 24 connected to the main transport path 22 to be guided into the eject roller 29. The eject roller 29 ejects the recording medium from the ejection port 28 to the ejector 16.

Next, the entire operation (color printing) of the image forming apparatus 10 will be described.

Figure 6:
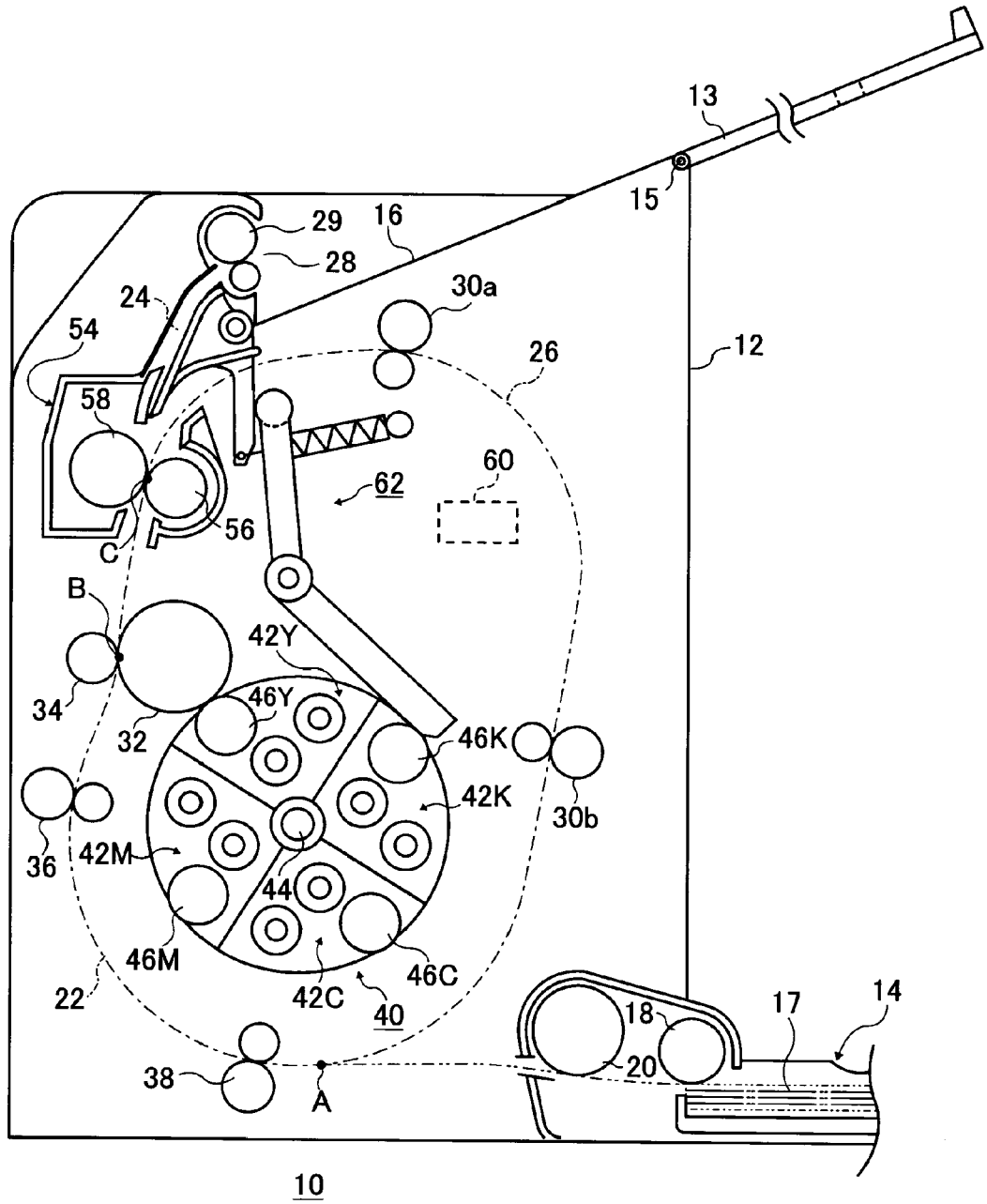
FIG. 6 is a side view illustrating a state of the image forming apparatus in color printing.

FIG. 6 is a side view illustrating a state of the image forming apparatus 10 in color printing.

Figure 7:
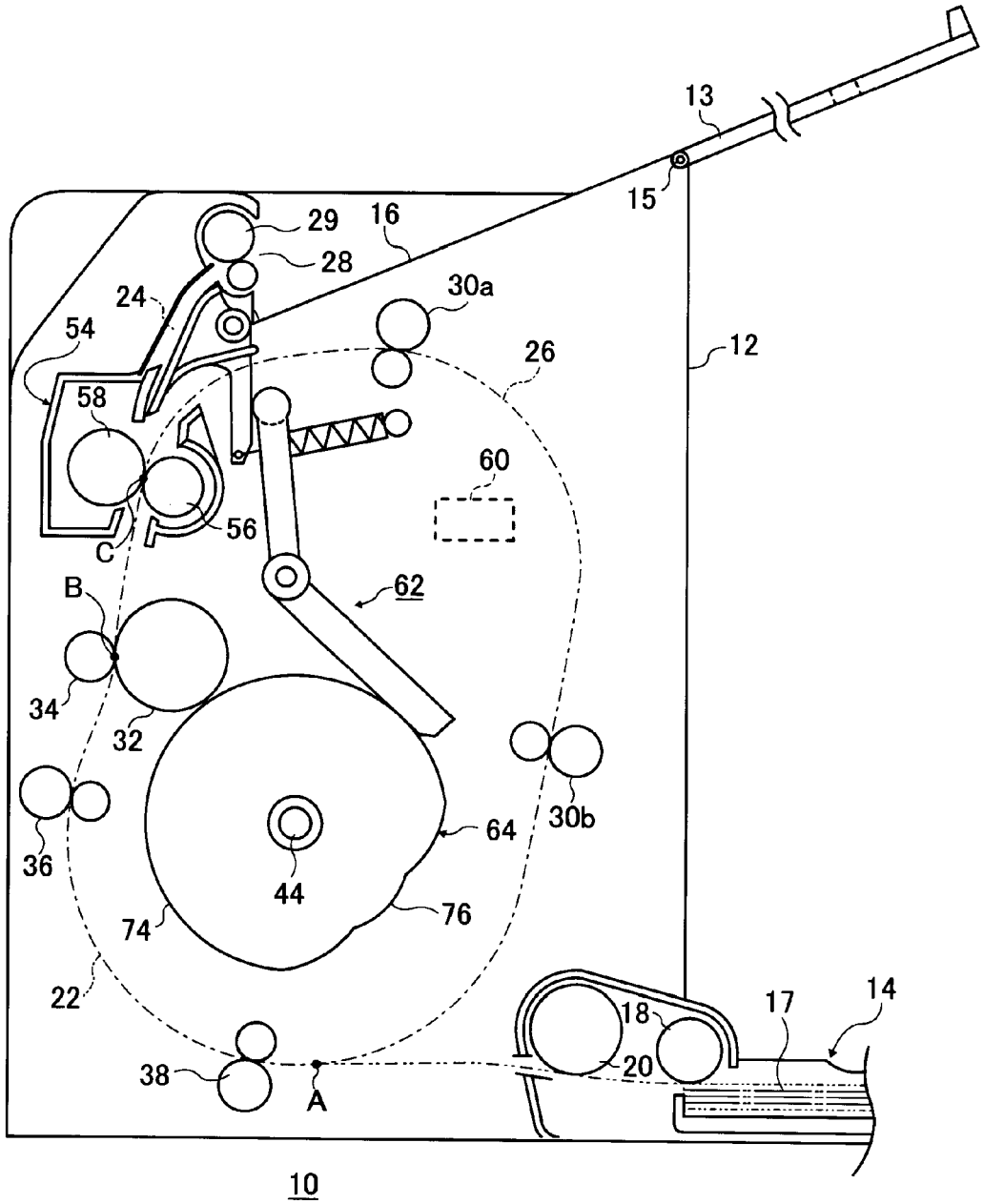
FIG. 7 is a side view illustrating the relationship between the transport path switching mechanism for the image forming apparatus shown in FIG. 6, and a circulating transport path and the main transport path.

FIG. 7 is a side view illustrating the relationship between the transport path switching mechanism 62 for the image forming apparatus 10 shown in FIG. 6, and the circulating transport path 26 and the main transport path 22.

As shown in FIG. 6, in the case where color printing is performed on, for example, an A4 size recording medium, the opening and closing portion 13 is opened by, for example, a user to thereby form the ejector 16 on an upper portion of the image forming apparatus chassis 12, and then the paper feed unit 14 is opened by, for example, a user to store recording media in the paper cassette 17, thereby allowing the image forming apparatus 10 to perform a printing operation.

When an image forming signal corresponding to color printing is transmitted to the image forming apparatus 10, the image carrier 32 is uniformly charged by the charging device 48, and then a light beam corresponding to a yellow image is emitted from the exposure device 52 to the charged image carrier 32 based on the image signal. The surface of the image carrier 32 is exposed to the light beam emitted from the exposure device 52, so that an electrostatic latent image is formed thereon. In the case of the color printing, the controller 60 rotates the rotary development device 40 so that, for example, the developing roller 46Y of the developing device 42Y is first opposed to the image carrier 32, and applies a predetermined voltage (developing bias) to the developing roller 46Y.

When the rotary development device 40 rotates so that the developing roller 46Y of the developing device 42Y is opposed to the image carrier 32, the cam 64 rotates to bring the cylindrical portion 74 into contact with the arm portion 80 as shown in FIGS. 3F and 7 and displace the first displacement member 66 and the second displacement member 68, so that the main transport path 22 is connected to the circulating transport path 26.

The electrostatic latent image carried by the image carrier 32 is developed with a yellow developer supplied to the developing roller 46Y of the developing device 42Y to be transferred to the recording medium supplied from the paper feed unit 14 through the main transport path 22. The recording medium with the yellow developer image transferred thereto is guided to the fixing device 54, at which the yellow developer image is fixed onto the recording medium by the heating roller 56 and the pressure roller 58.

The recording medium with the yellow developer image fixed thereon is guided to the circulating transport path 26 connected to the main transport path 22 to be transported to the transfer position B through the merging point A into the main transport path 22, and the registration roller 36. The developer remaining on the image carrier 32 is scraped and recovered by the image carrier cleaner 50.

The image carrier 32 is uniformly charged again by the charging device 48, and then a light beam corresponding to a magenta image is emitted from the exposure device 52 to the charged image carrier 32 based on the image signal. The surface of the image carrier 32 is exposed to the light beam emitted from the exposure device 52, so that an electrostatic latent image is formed thereon.

The controller 60 rotates the rotary development device 40 so that the developing roller 46M of the developing device 42M is opposed to the image carrier 32, and a predetermined voltage (developing bias) is applied to the developing roller 46M.

When the rotary development device 40 is rotated so that the developing roller 46M of the developing device 42M is opposed to the image carrier 32, the cam 64 rotates with the cylindrical portion 74 brought into contact with the arm portion 80 as shown in FIG. 3G, and the connection between the main transport path 22 and the circulating transport path 26 is maintained.

The electrostatic latent image carried by the image carrier 32 is developed with a magenta developer supplied to the developing roller 46M of the developing device 42M. The magenta developer image carried by the image carrier 32 is superimposed and transferred onto the recording medium with the yellow developer image transferred thereto.

The recording medium with the magenta developer image transferred thereto is guided to the fixing device 54, at which the magenta developer image is fixed onto the recording media by the heating roller 56 and the pressure roller 58.

The recording medium with the magenta developer image fixed thereon is guided to the circulating transport path 26 connected to the main transport path 22 to be transported to the transfer position B through the merging point A into the main transport path 22, and the registration roller 36. The developer remaining on the image carrier 32 is scraped and recovered by the image carrier cleaner 50.

The image carrier 32 is uniformly charged again by the charging device 48, and then a light beam corresponding to a cyan image is emitted from the exposure device 52 to the charged image carrier 32 based on the image signal. The surface of the image carrier 32 is exposed to the light beam emitted from the exposure device 52, so that an electrostatic latent image is formed thereon.

The controller 60 rotates the rotary development device 40 so that the developing roller 46C of the developing device 42C is opposed to the image carrier 32, and applies a predetermined voltage (developing bias) to the developing roller 46C.

When the rotary development device 40 rotates so that the developing roller 46C of the developing device 42C is opposed to the image carrier 32, the cam 64 rotates with the cylindrical portion 74 brought into contact with the arm portion 80 as shown in FIG. 3H, so that the connection between the main transport path 22 and the circulating transport path 26 is maintained.

The electrostatic latent image carried by the image carrier 32 is developed with a cyan developer supplied to the developing roller 46C of the developing device 42C. The cyan developer image carried by the image carrier 32 is further superimposed and transferred onto the recording medium with the magenta developer image transferred thereto.

The recording medium with the cyan developer image transferred thereto is guided to the fixing device 54, at which the cyan developer image is fixed onto the recording media by the heating roller 56 and the pressure roller 58.

The recording medium with the cyan developer image fixed thereon is guided to the circulating transport path 26 connected to the main transport path 22 to be transported to the transfer position B through the merging point A into the main transport path 22, and the registration roller 36. The developer remaining on the image carrier 32 is scraped and recovered by the image carrier cleaner 50.

The image carrier 32 is uniformly charged again by the charging device 48, and then a light beam corresponding to a black image is emitted from the exposure device 52 to the charged image carrier 32 based on the image signal. The surface of the image carrier 32 is exposed to the light beam emitted from the exposure device 52, so that an electrostatic latent image is formed thereon.

The controller 60 rotates the rotary development device 40 so that the developing roller 46K of the developing device 42K is opposed to the image carrier 32, and applies a predetermined voltage (developing bias) to the developing roller 46K.

When the rotary development device 40 rotates so that the developing roller 46K of the developing device 42K is opposed to the image carrier 32, the cam 64 rotates to bring the displacement forming portion 76 into contact with the arm portion 80 as shown in FIGS. 3E and 5 and displaces the first displacement member 66 and the second displacement member 68, so that the main transport path 22 is connected to the ejecting transport path 24.

The electrostatic latent image carried by the image carrier 32 is developed with a black developer supplied to the developing roller 46K of the developing device 42K to be transferred to the recording medium supplied from the paper feed unit 14 through the main transport path 22. The developer remaining on the image carrier 32 is scraped and recovered by the image carrier cleaner 50. The recording medium with the black developer image transferred thereto is guided to the fixing device 54, at which the black developer image is fixed onto the recording medium by the heating roller 56 and the pressure roller 58.

The recording medium with the black developer image fixed thereon is guided to the ejecting transport path 24 connected to the main transport path 22 to be guided into the eject roller 29. The eject roller 29 ejects the recording medium from the ejection port 28 to the ejector 16.

Hereinafter, a second exemplary embodiment of the present invention will be described with reference to the accompanying drawings.

Figure 8:
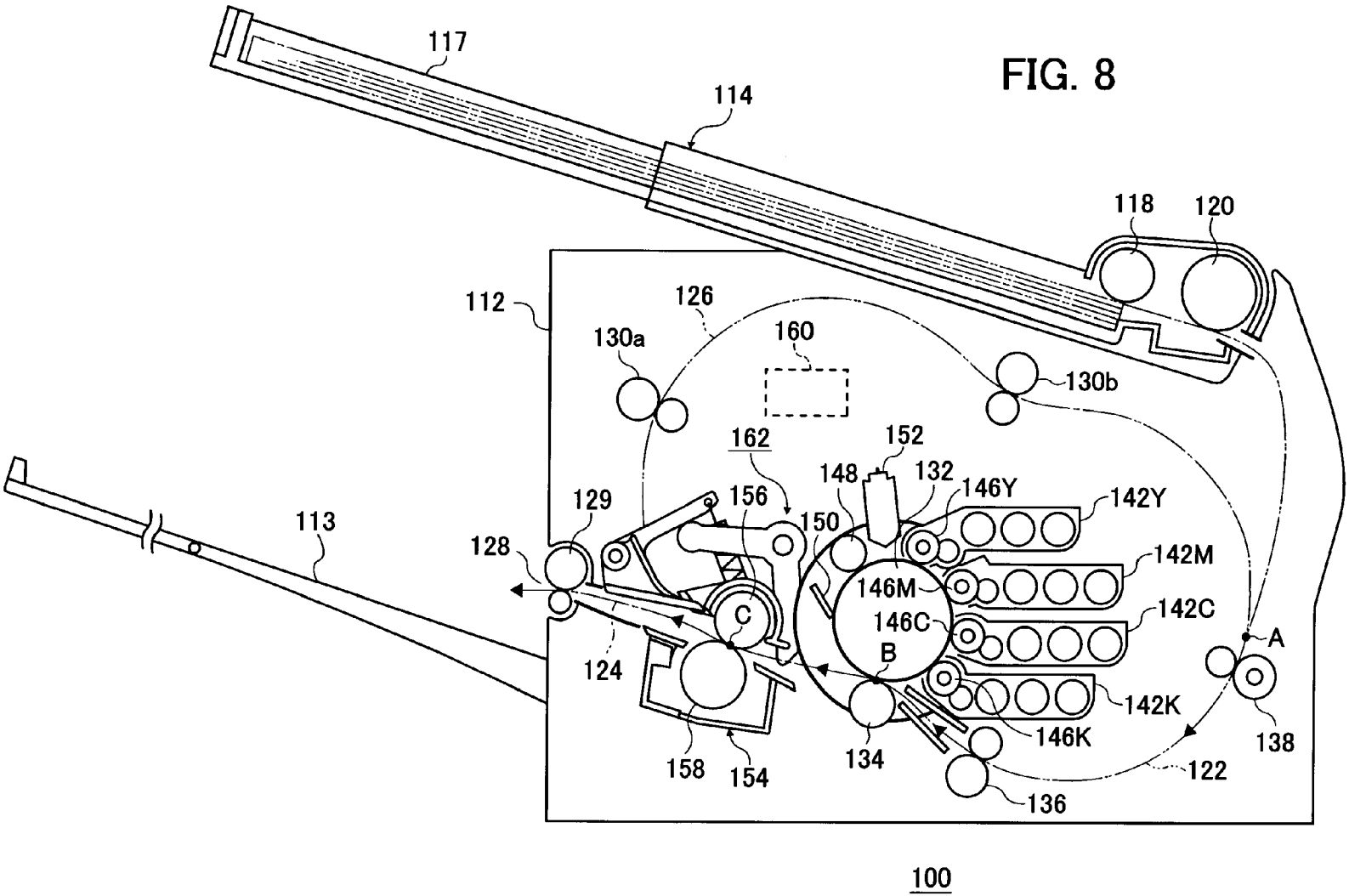
FIG. 8 is a schematic side view of an image forming apparatus according to the second exemplary embodiment of the invention.

FIG. 8 illustrates schematically an image forming apparatus 100 according to the second exemplary embodiment of the invention. The image forming apparatus 100 includes an image forming apparatus chassis 112. An ejector 113 is provided on the front side of the image forming apparatus chassis 112 (the left side in FIG. 8), and a paper feed unit 114 is provided, for example, on an upper portion of the image forming apparatus chassis 112.

The paper feed unit 114 includes a paper cassette 117 for storing recording media such as paper. The paper cassette 117 is designed to be extensible, and the maximum size of the recording medium capable of being stored therein is, for example, A4 size paper. Also, the paper cassette 117 is provided with a pickup roller 118 for drawing the recording medium from the paper cassette 117.

The recording media drawn from the paper cassette 117 by the pickup roller 118 are separated by a feed roller 120 and a separation member (not shown) to be transported one by one to a main transport path 122. The main transport path 122 serves as a recording medium passage from the pickup roller 118 to a fixing device 154 to be described later. Also, the main transport path 122 is selectively connected to an ejecting transport path 124 or a circulating transport path 126 on the downstream side of the fixing device 154 by a switching mechanism 162 to be described later with reference to FIGS. 10A to 11, and the like.

The ejecting transport path 124 serves as a recording medium passage from the fixing device 154 to an ejection port 128. Also, an eject roller 129 is provided in the vicinity of the ejection port 128 of the main transport path 122. The circulating transport path 126 serves as a recording medium passage from the fixing device 154 to a merging point A into the main transport path 122, and includes transport rollers 130*a* and 130*b* for transporting the recording medium to form a circulating path for circulating the recording medium in combination with the main transport path 122.

An image carrier 132 and a transfer roller 134 having an elastic surface are provided on the upstream side of the fixing device 154 on the main transport path 122. The contact portion between the image carrier 132 and the transfer roller 134 corresponds to a transfer position B where a developer image carried by the image carrier 132 is transferred to a recording medium. A registration roller 136 is provided on the upstream side of the image carrier 132 and the transfer roller 134, and a transport roller 138 for transporting the recording medium is provided on the upstream side of the registration roller 136.

Thus, the recording medium drawn from the paper cassette 117 of the paper feed unit 114 by the pickup roller 118 is guided to the main transport path 122 to be transported to the transport roller 138. The recording medium is temporarily stopped by the registration roller 136 to pass between the image carrier 132 and the transfer roller 134 with a predetermined timing, where for example, a black developer image is transferred to the recording medium. The transferred black developer image is fixed onto the recording medium by the fixing device 154, and the recording medium is ejected from the ejection port 128 to the ejector 113 by the eject roller 129.

In the case where a developer image of the color other than black is transferred and fixed, however, the main transport path 122 is connected to the circulating transport path 126 by the switching mechanism 162 to allow the recording medium to circulate through the circulating transport path 126.

In the image forming apparatus chassis 112, for example, on the generally central back side thereof, there are provided a developing device 142Y for storing a yellow developer, a developing device 142M for storing a magenta developer, a developing device 142C for storing a cyan developer, and a developing device 142K for storing a black developer. The developing devices 142Y, 142M, 142C, and 142K have respective developing rollers 146Y, 146M, 146C, and 146K, and sequentially visualize an electrostatic latent image carried by the image carrier 132, with the respective developers.

On an upper portion of the image carrier 132, there is provided an charging device 148 composed of, for example, a charging roller, for uniformly charging the image carrier 132. In other words, a developing bias is applied to the image carrier 132. Also, an image carrier cleaner 150 abuts on the image carrier 132 on the upstream side of the charging device 148 in the rotation direction of the image carrier 132. The image carrier cleaner 150 scrapes off the developer remaining on the image carrier 132 after transfer.

On an upper portion of the image carrier 132, there is provided an exposure device 152 for writing an electrostatic latent image on the image carrier 132 charged by the charging device 148, by means of light rays, such as laser beams. Also, the transfer roller 134 described above is disposed on a lower portion of the image carrier 132. The transfer roller 134 sequentially superimposes and transfers the developer images visualized by the developing devices 142Y, 142M, 142C, and 142K onto the recording medium at the transfer position B.

The fixing device 154, provided downstream of the transfer position B, includes a heating roller 156 and a pressure roller 158, and transports the recording medium with the developer image transferred by the image carrier 132 and the transfer roller 134 while holding the recording medium using a contact portion (nip portion: fixing position C) between the heating roller 156 and the pressure roller 158 to fix the developer image onto the recording medium by heating and pressing the developer image.

In the image forming apparatus chassis 112, a controller 160 for controlling respective components composing the image forming apparatus 100 is also provided.

Next, a driving system 164 for driving the developing rollers 146Y, 146M, 146C, and 146K, and the switching mechanism 162 will be described in detail.

Figure 9A:
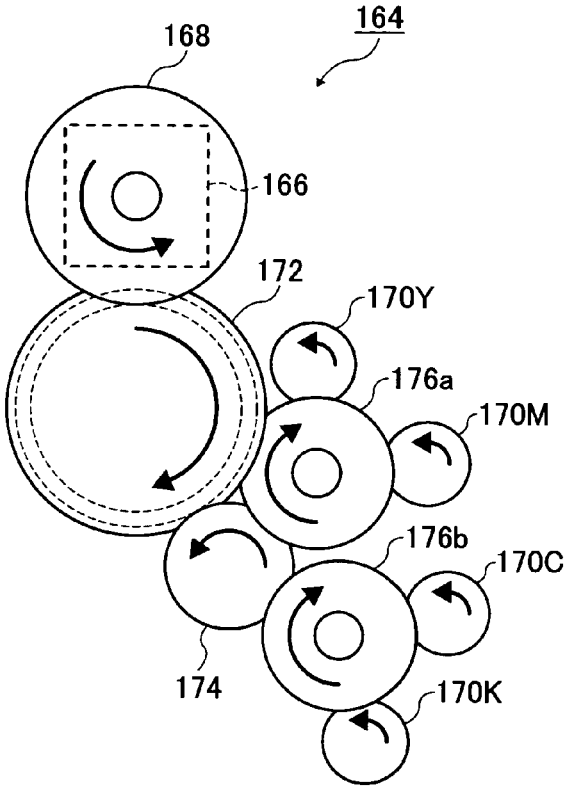
Figure 9B:
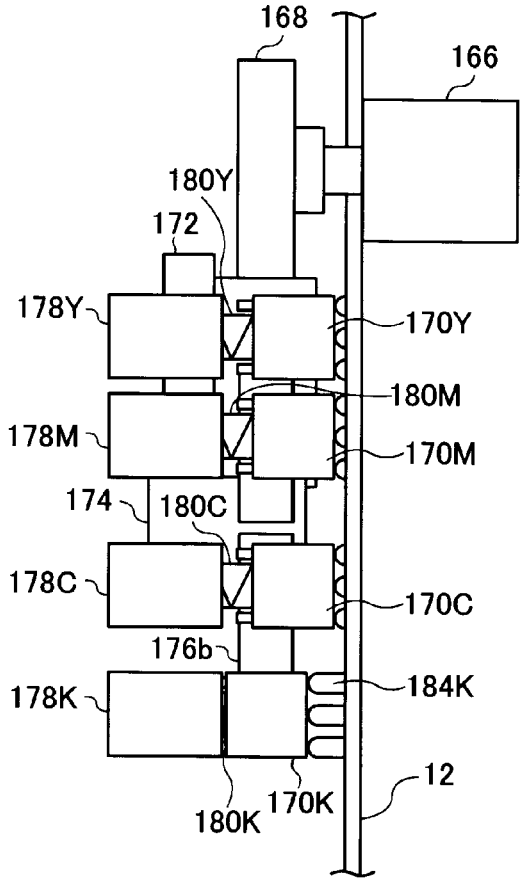

FIGS. 9A and 9B are views illustrating the driving system 164 for driving the developing rollers 146Y, 146M, 146C, and 146K. FIG. 9A is a side view of the driving system 164, and FIG. 9B is a front view of the driving system 164. A motor 166 is connected to a rotary shaft of a gear 168 to drive the gear 168.

A transmitting member 170Y is driven by the motor 166 through the gears 168, 172, 174, 176*a* to transmit a driving force of the motor 166 to a transmitted member 178Y fixed to the developing roller 146Y according to the operation of the switching mechanism 162 to be described in detail with reference to FIGS. 10A to 11, and the like. A transmitting member 170M is driven by the motor 166 through the gears 168, 172, 174, 176*a* to transmit a driving force of the motor 166 to a transmitted member 178M fixed to the developing roller 146M according to the operation of the switching mechanism 162. A transmitting member 170C is driven by the motor 166 through the gears 168, 172, 174, 176*b* to transmit a driving force of the motor 166 to a transmitted member 178C fixed to the developing roller 146C according to the operation of the switching mechanism 162. A transmitting member 170K is driven by the motor 166 through the gears 168, 172, 174, 176*b* to transmit a driving force of the motor 166 to a transmitted member 178K fixed to the developing roller 146K according to the operation of the switching mechanism 162.

That is to say, the transmitting members 170Y, 170M, 170C, and 170K are coupled to the transmitted members 178Y, 178M, 178C, and 178K, respectively to transmit a driving force of the motor 166 to the developing rollers 146Y, 146M, 146C, and 146K individually. Also, between the transmitting members 170Y, 170M, 170C, and 170K, and the transmitted members 178Y, 178M, 178C, and 178K, there are provided elastic members 180Y, 180, 180C, and 180K such as springs for urging the transmitting members 170Y, 170, 170C, and 170K in a direction to be separated from the transmitted members 178Y, 178M, 178C, and 178K, respectively.

Figure 10B:
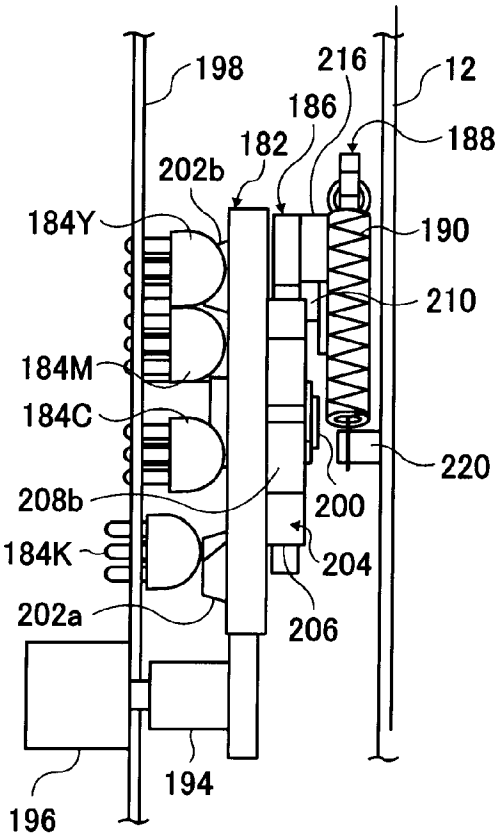
Figure 10A:
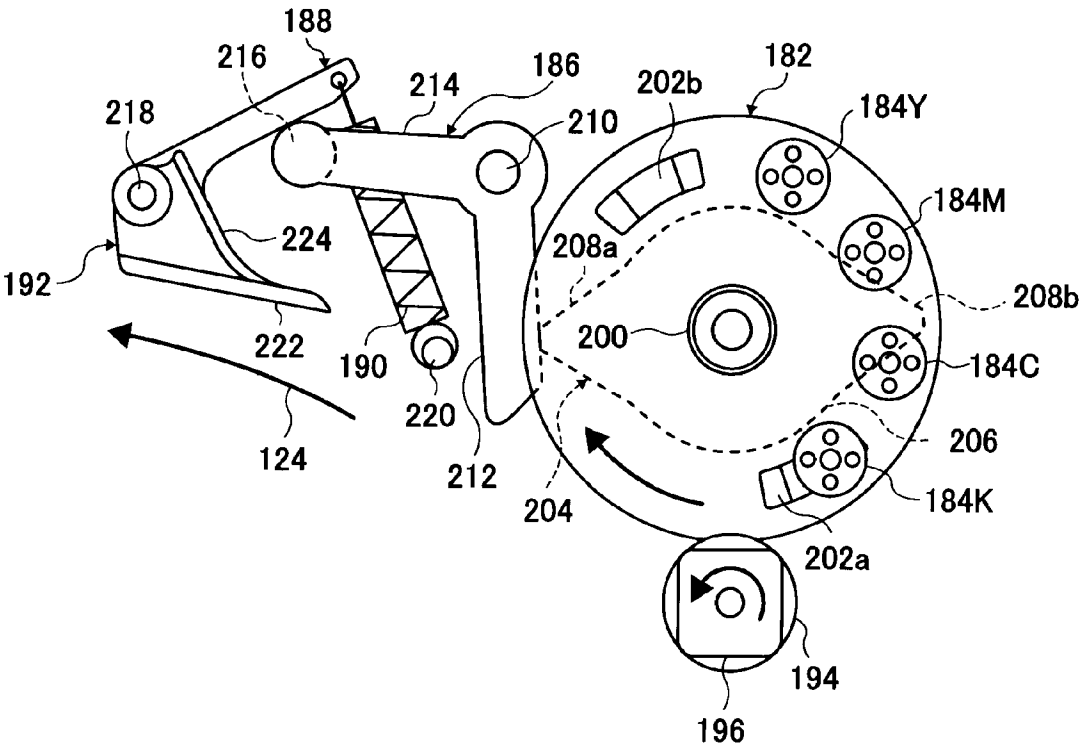

FIGS. 10A and 10B are views illustrating the switching mechanism 162. FIG. 10A is a side view of the switching mechanism 162, and FIG. 10B is an enlarged front view of the switching mechanism 162.

Figure 11:
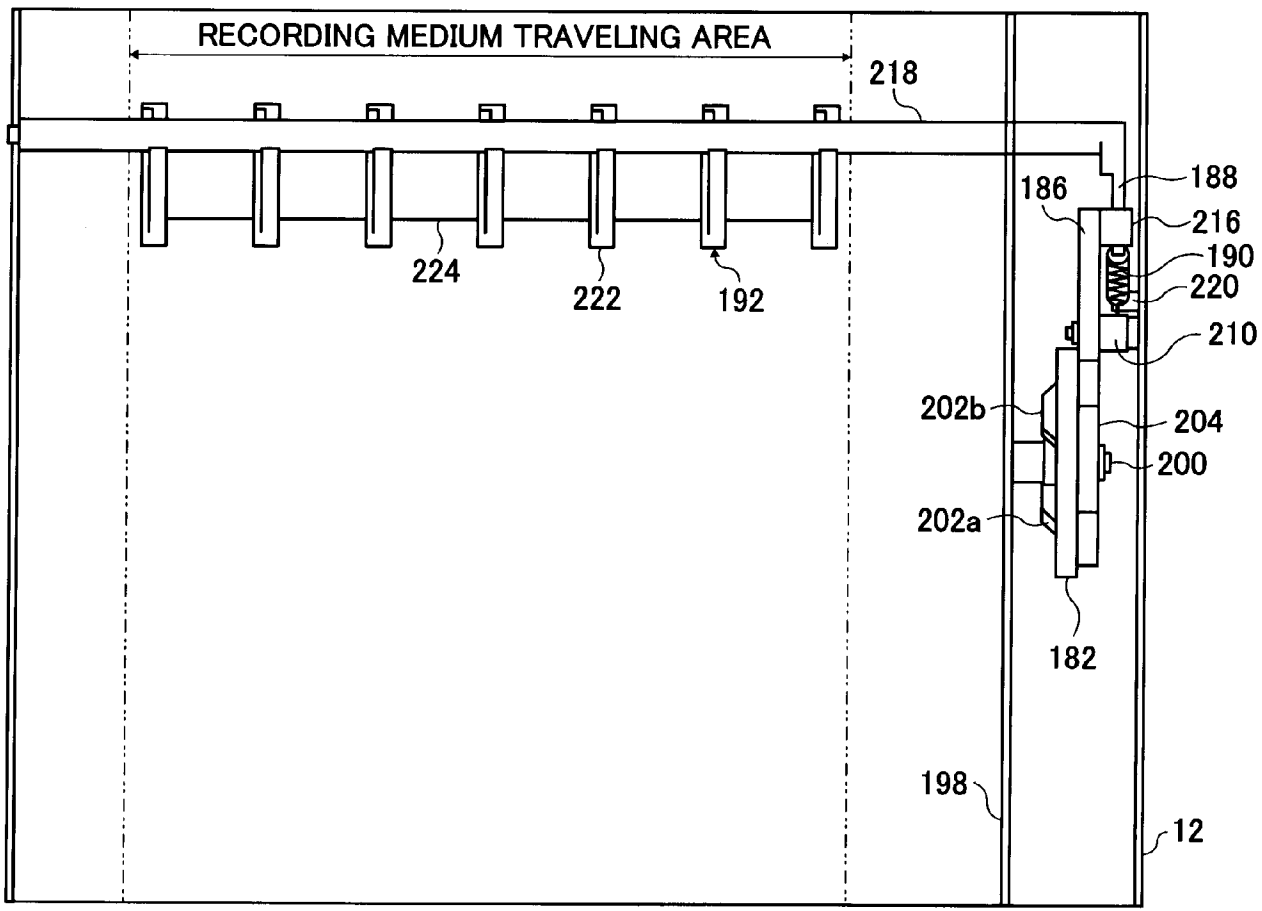
FIG. 11 is a front view illustrating the switching mechanism and its periphery.

FIG. 11 is a front view illustrating the switching mechanism 162 and its periphery.

The switching mechanism 162 includes a rotating plate 182, moving members 184Y, 184M, 184C, and 184K, a first displacement member 186, a second displacement member 188, an elastic member 190, and a claw member 192. The rotating plate 182 is driven by a motor 196 through a gear 194, thereby operating the switching mechanism 162.

The rotating plate 182 is supported rotatably about a shaft 200 on a partition plate 198 provided in the image forming apparatus chassis 112, and is rotatable generally parallel to the image forming apparatus chassis 112 and the partition plate 198. On the surface facing the partition plate 198 of the rotating plate 182, projecting portions 202*a* and 202*b* are opposed to each other across the shaft 200. Also, on the surface facing the image forming apparatus chassis 112 of the rotating plate 182, a cam 204 to rotate about the shaft 200 is provided.

The projecting portions 202*a* and 202*b* rotate about the shaft 200 in association with the rotation of the rotating plate 182. During one rotation of the rotating plate 182, each of the projecting portions 202*a* and 202*b* is brought into contact with the moving members 184Y, 184M, 184C, and 184K on a one-time basis to move the moving members 184Y, 184M, 184C, and 184K to the partition plate 198 on a one-time basis. When the moving members 184Y, 184M, 184C, and 184K are moved by the projecting portions 202*a* and 202*b*, a part of each of the moving members 184Y, 184M, 184C, and 184K passes sequentially through the partition plate 198, thereby sequentially connecting the transmitting members 170Y, 170M, 170C, and 170K (see FIG. 9B) to the transmitted members 178Y, 178M, 178C, and 178K. On the other hand, when the moving members 184Y, 184M, 184C, and 184K are not moved to the partition plate 198 by the projecting portions 202*a* and 202*b*, the moving members 184Y, 184M, 184C, and 184K are moved from the partition plate 198 to the rotating plate 182 by the transmitting members 170Y, 170M, 170C, and 170K urged by the elastic members 180Y, 180M, 180C, and 180K.

In other words, the transmitting member 170Y, 170M, 170C, or 170K moved by any one of the moving members 184Y, 184M, 184C, and 184K moved by the projecting portions 202*a* and 202*b*, is adapted to transmit a driving force to the corresponding transmitted member 178Y, 178M, 178C, or 178K.

The cam 204 includes a cylindrical portion 206 having a uniform distance from the shaft 200 to the outer peripheral surface thereof, and displacement forming portions 208*a* and 208*b* with a distance from the shaft 200 to the outer peripheral surface thereof longer than that of the cylindrical portion 206. The displacement forming portions 208*a* and 208*b* are opposed to each other across the shaft 200.

The first displacement member 186 is rotatable about a shaft 210 fixed to the image forming apparatus chassis 112, and includes two arm portions 212 and 214 extending in different directions from the shaft 210. The arm portion 212 is brought into slidable contact with an outer peripheral surface of the cam 204, so that the displacement forming portion 208*a*, the cylindrical portion 206, the displacement forming portion 208*b*, and the cylindrical portion 206 are sequentially brought into contact with the arm portion 212. On the end of the arm portion 214 on the opposite side of the shaft 210, a protrusion 216 protruding in the direction parallel to the shaft 210 is provided so that the arm portion 214 is brought into slidable contact with the second displacement member 188.

The second displacement member 188 has one end fixed to a shaft 218 rotatably fixed to the image forming apparatus chassis 112, and is rotatable about the shaft 218. Also, the second displacement member 188 has the other end attached to one end of the elastic member 190.

Examples of the elastic member 190 include a spring. The elastic member 190, having one end attached to an end of the second displacement member 188, and the other end attached to a protruding portion 220 protruding from the image forming apparatus chassis 112, urges the end (the opposite side of the shaft 218) of the second displacement member 188 in a direction to approach the protruding portion 220.

The claw member 192 includes a first guide portion 222 composed of, for example, plural claws, and a second guide portion 224 in a recording medium traveling area shown in FIG. 11, and is fixed to the shaft 218 to be displaced in conjunction with displacement of the second displacement member 188. The first guide portion 222 is adapted to form a part of the ejecting transport path 124, and the second guide portion 224 is adapted to form a part of the circulating transport path 126.

Next, the operation of the switching mechanism 162 will be described.

FIGS. 12A to 15C illustrate sequentially the operation of the switching mechanism 162.

Figure 12B:
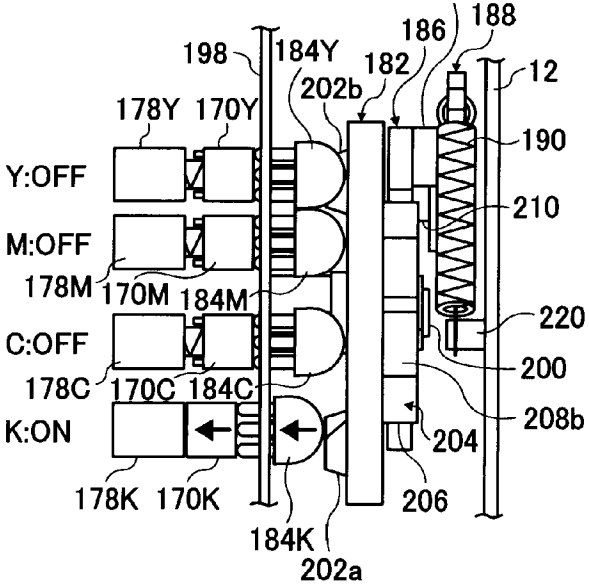
FIGS. 12A to 12C are views illustrating a state in which a rotating plate rotates so as to drive the developing roller for developing an electrostatic latent image with a black developer and connect a main transport path to an ejecting transport path.
Figure 12A:
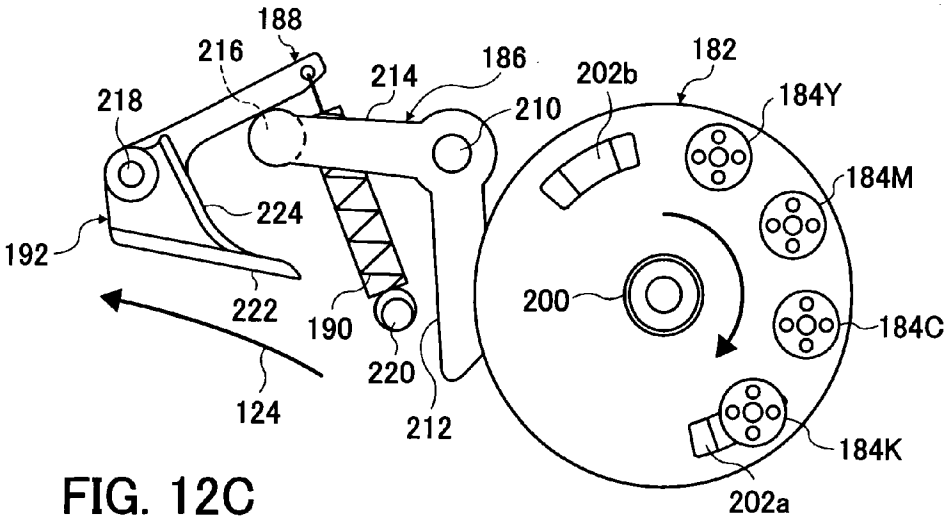

When the rotating plate 182 rotates about the shaft 200 to bring the projecting portions 202*a* into contact with the moving member 184K as shown in FIG. 12A, a part of the moving member 184K passes through the partition plate 198, thereby connecting the transmitting member 170K to the transmitted member 178K as shown in FIG. 12B.

Figure 12C:
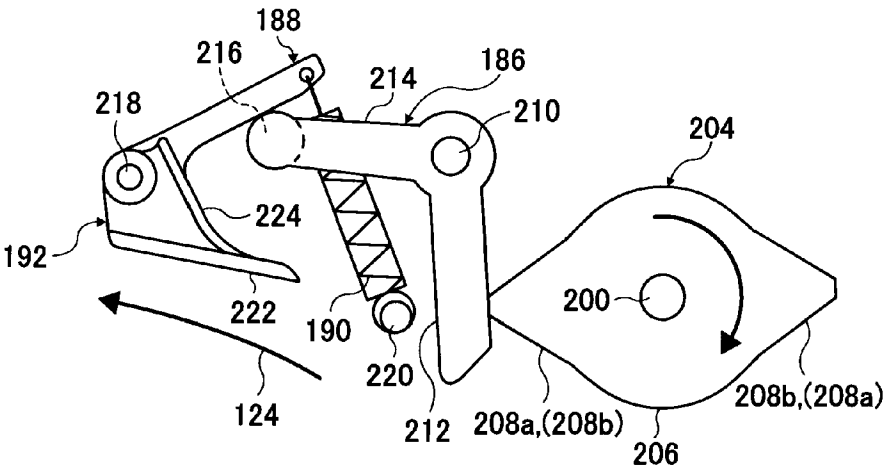

Also, when the rotating plate 182 rotates about the shaft 200 to bring the projecting portion 202*a* into contact with the moving member 184K as shown in FIG. 12A, the cam 204 rotates to bring the displacement forming portions 208*a* of the cam 204 into contact with the arm portion 212 of the first displacement member 186 as shown in FIG. 12C. In that case, since the protrusion 216 of the arm portion 214 is displaced about the shaft 210 in a direction to be separated from the protruding portion 220, the end of the second displacement member 188 on the opposite side of the shaft 218 is separated from the protruding portion 220, and the claw member 192 is displaced (moved counterclockwise in FIG. 12C) in the direction where the first guide portion 222 forms a part of the ejecting transport path 124.

In other words, the rotating plate 182 rotates so that the projecting portion 202*a* (or 202*b*) moves the moving member 184K to thereby connect the transmitting member 170K to the transmitted member 178K and transmit a driving force (FIG. 9B) of the motor 166 to the developing roller 146K (FIG. 8). Also, the displacement forming portion 208*a* (or 208*b*) displaces the first displacement member 186 and the second displacement member 188, and the claw member 192 is displaced in the direction where the first guide portion 222 forms a part of the ejecting transport path 124.

Figure 13B:
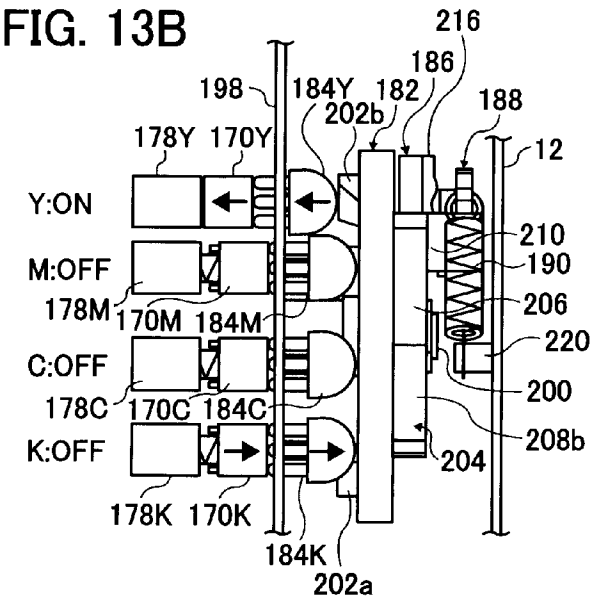
FIGS. 13A to 13C are views illustrating a state in which the rotating plate rotates so as to drive the developing roller for developing the electrostatic latent image with a yellow developer and connect the main transport path to a circulating transport path.
Figure 13A:
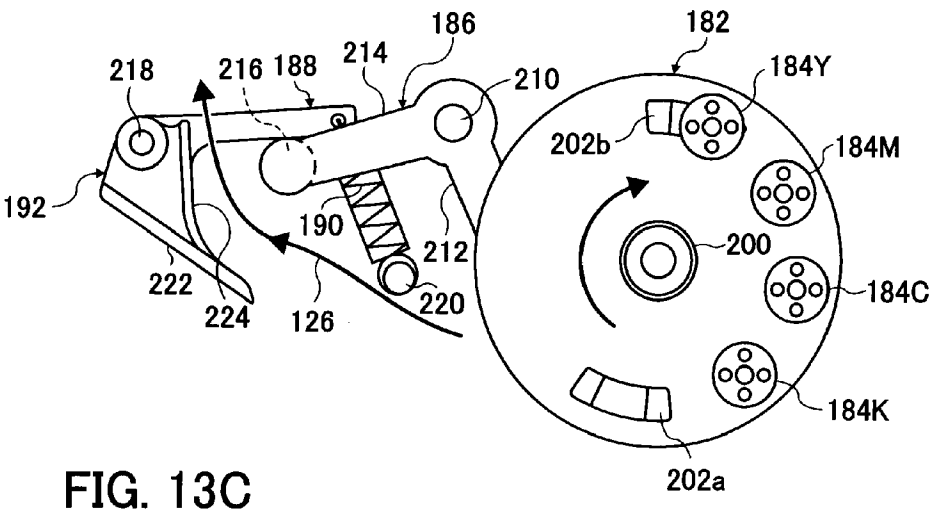

When the rotating plate 182 rotates about the shaft 200 to bring the displacement forming portion 208*b* into contact with the moving member 184Y as shown in FIG. 13A, a part of the moving member 184Y passes through the partition plate 198, thereby connecting the transmitting member 170Y to the transmitted member 178Y as shown in FIG. 13B.

Figure 13C:
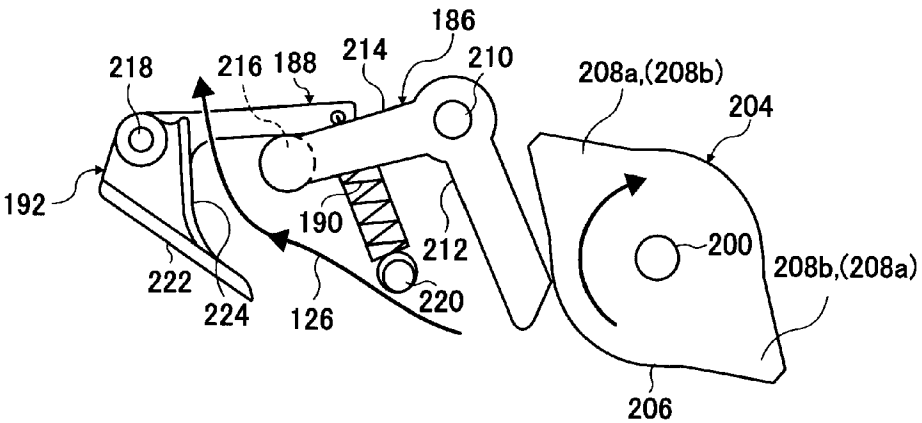

Also, when the rotating plate 182 rotates about the shaft 200 to bring the projecting portion 202*b* into contact with the moving member 184Y as shown in FIG. 13A, the cam 204 rotates to bring the cylindrical portion 206 of the cam 204 into contact with the arm portion 212 of the first displacement member 186 as shown in FIG. 13C. In that case, since the protrusion 216 of the arm portion 214 is displaced about the shaft 210 in a direction to approach the protruding portion 220, the end of the second displacement member 188 on the opposite side of the shaft 218 approaches the protruding portion 220, and the claw member 192 is displaced (moved clockwise in FIG. 13C) in the direction where the second guide portion 224 forms a part of the circulating transport path 126.

In other words, the rotating plate 182 rotates so that the projecting portion 202*b* (or 202*a*) moves the moving member 184Y to thereby connect the transmitting member 170Y to the transmitted member 178Y and transmit a driving force (FIG. 9B) of the motor 166 to the developing roller 146Y (FIG. 8). Also, the cylindrical portion 206 displaces the first displacement member 186 and the second displacement member 188, and the claw member 192 is displaced in the direction where the second guide portion 224 forms a part of the circulating transport path 126.

Figure 14B:
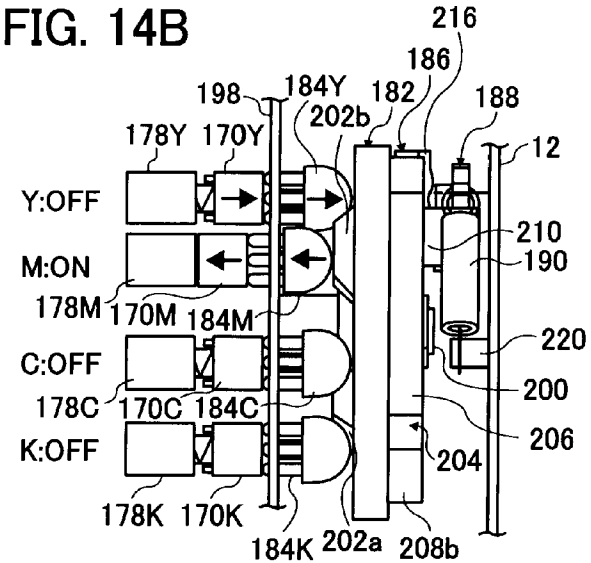
FIGS. 14A to 14C are views illustrating a state in which the rotating plate rotates so as to drive the developing roller for developing the electrostatic latent image with a magenta developer and connect the main transport path to the circulating transport path.
Figure 14A:
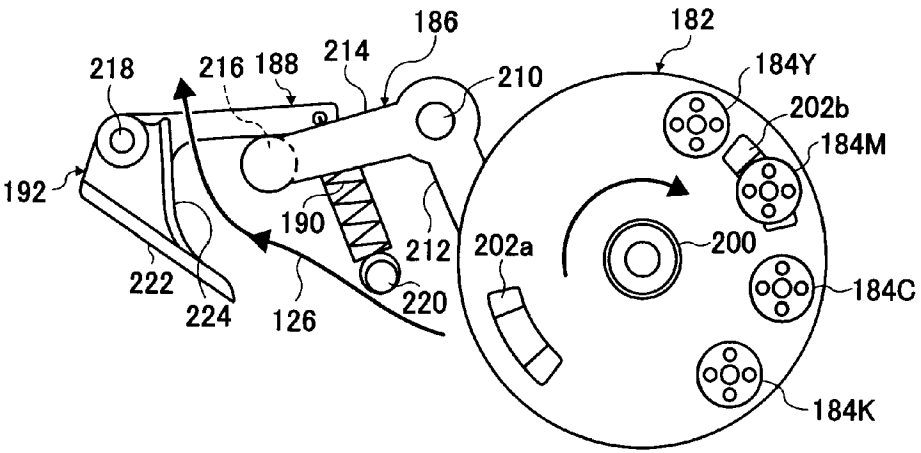

When the rotating plate 182 rotates about the shaft 200 to bring the displacement forming portion 208*b* into contact with the moving member 184M as shown in FIG. 14A, a part of the moving member 184M passes through the partition plate 198, thereby connecting the transmitting member 170M to the transmitted member 178M as shown in FIG. 14B.

Figure 14C:
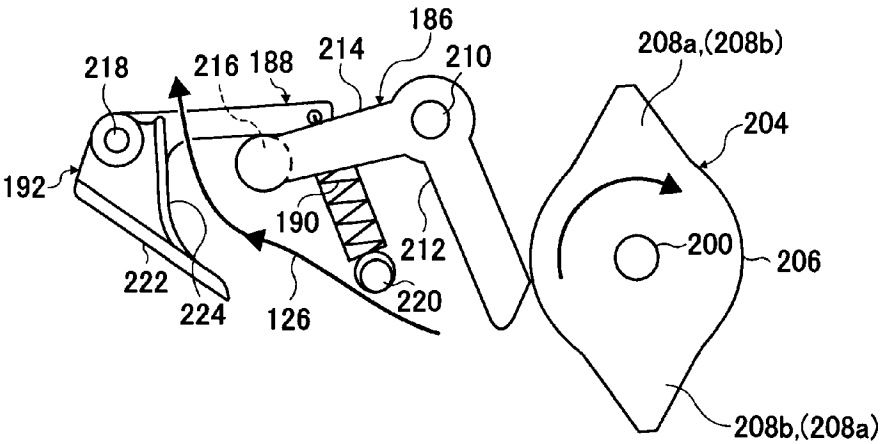

Also, when the rotating plate 182 rotates about the shaft 200 to bring the projecting portion 202*b* into contact with the moving member 184M as shown in FIG. 14A, the cam 204 rotates with the cylindrical portion 206 of the cam 204 brought into contact with the arm portion 212 of the first displacement member 186 as shown in FIG. 14C. In that case, since the position of the protrusion 216 is maintained, the state in which the second guide portion 224 forms a part of the circulating transport path 126 is maintained.

In other words, the rotating plate 182 rotates so that the projecting portion 202*b* (or 202*a*) moves the moving member 184M to thereby connect the transmitting member 170M to the transmitted member 178M and transmit a driving force (FIG. 9B) of the motor 166 to the developing roller 146M (FIG. 8). Also, the cylindrical portion 206 maintains the positions of the first displacement member 186 and the second displacement member 188, and the state in which the second guide portion 224 forms a part of the circulating transport path 126 is maintained.

Figure 15B:
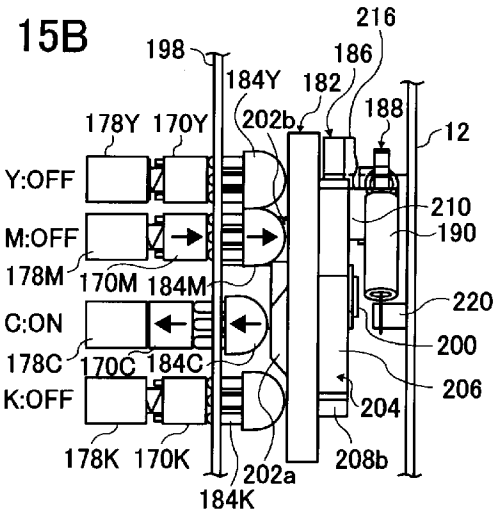
FIGS. 15A to 15C are views illustrating a state in which the rotating plate rotates so as to drive the developing roller for developing the electrostatic latent image with a cyan developer and connect the main transport path to the circulating transport path.
Figure 15A:
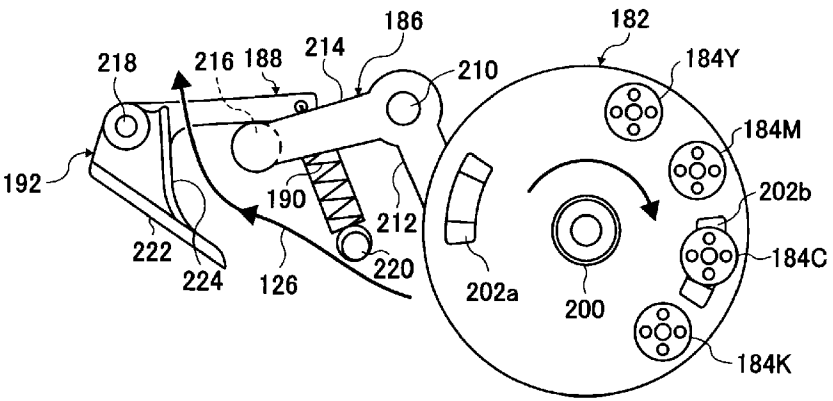

When the rotating plate 182 rotates about the shaft 200 to bring the displacement forming portion 208*b* into contact with the moving member 184C as shown in FIG. 15A, a part of the moving member 184C passes through the partition plate 198, thereby connecting the transmitting member 170C to the transmitted member 178C as shown in FIG. 15B.

Figure 15C:
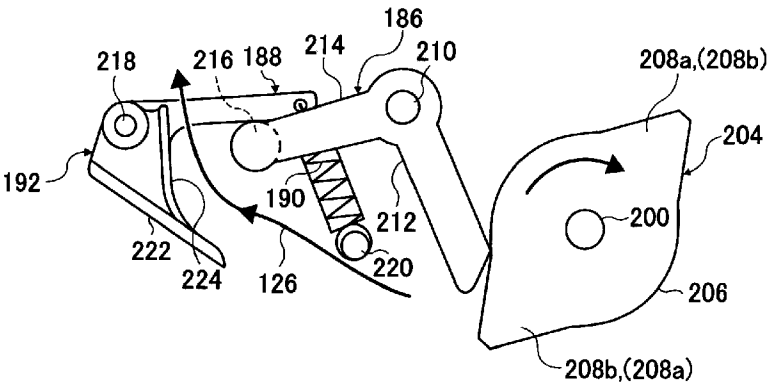

Also, when the rotating plate 182 rotates about the shaft 200 to bring the projecting portion 202*b* into contact with the moving member 184C as shown in FIG. 15A, the cam 204 rotates with the cylindrical portion 206 of the cam 204 brought into contact with the arm portion 212 of the first displacement member 186 as shown in FIG. 15C. In that case, since the position of the protrusion 216 is maintained, the state in which the second guide portion 224 forms a part of the circulating transport path 126 is maintained.

In other words, the rotating plate 182 rotates so that the projecting portion 202*b* (or 202*a*) moves the moving member 184C to thereby connect the transmitting member 170C to the transmitted member 178C and transmit a driving force (FIG. 9B) of the motor 166 to the developing roller 146C (FIG. 8). Also, the cylindrical portion 206 maintains the positions of the first displacement member 186 and the second displacement member 188, and the state in which the second guide portion 224 forms a part of the circulating transport path 126 is maintained.

As described above, by rotating the rotating plate 182 in a predetermined direction, the image forming apparatus 100 switches among the developing rollers 146Y, 146M, 146C, and 146K as the destination of the driving force, and also switches between the ejecting transport path 124 and the circulating transport path 126.

Next, the entire operation (printing in black and white) of the image forming apparatus 100 will be described.

Figure 16:
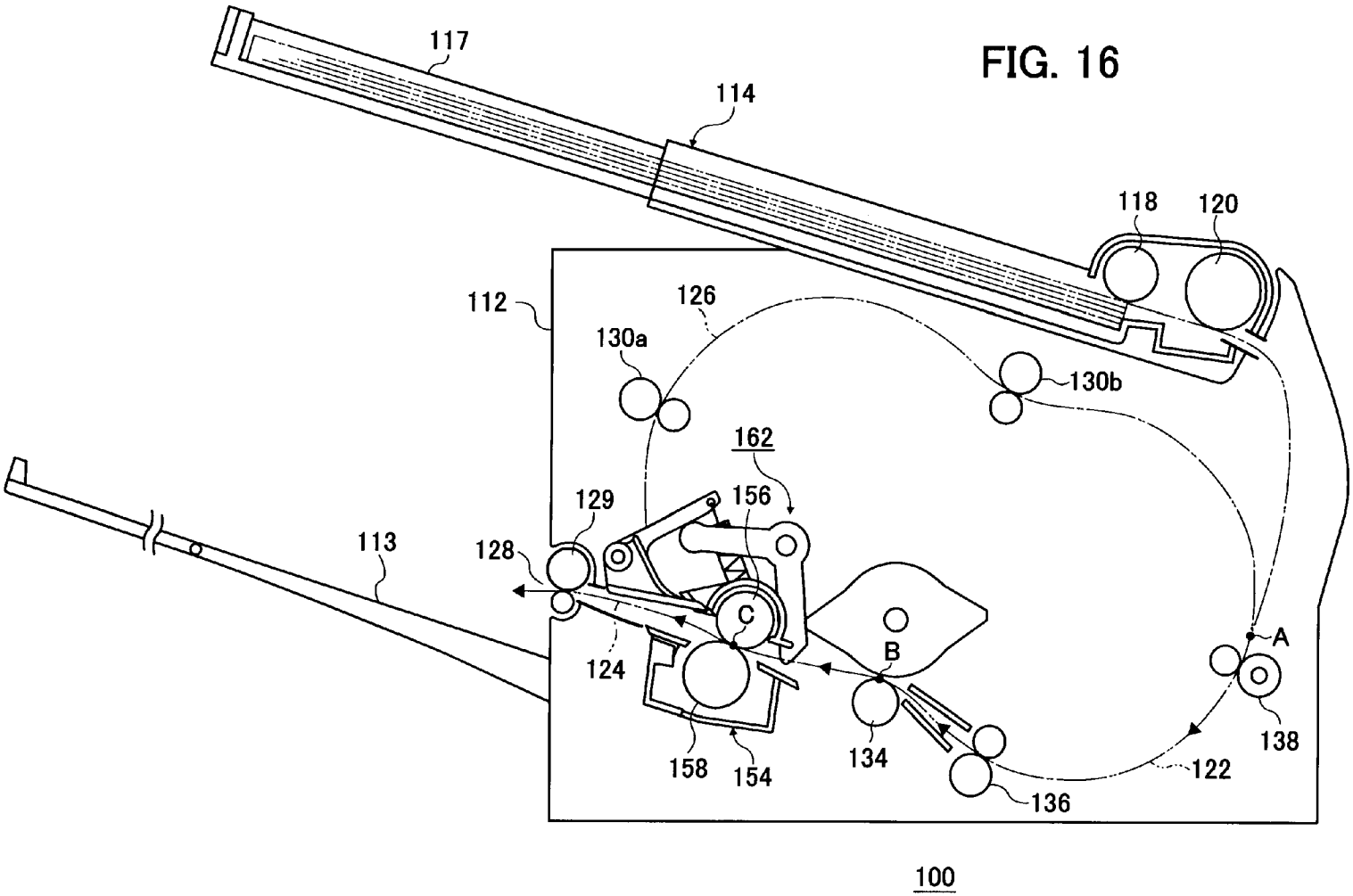
FIG. 16 is a side view illustrating the relationship between the switching mechanism for the image forming apparatus in black image printing as shown in FIG. 8, and the ejecting transport path and the main transport path.

FIG. 16 is a side view illustrating the relationship between the switching mechanism 162 for the image forming apparatus 100 shown in FIG. 8, and the ejecting transport path 124 and the main transport path 122.

When an image forming signal corresponding to black-and-white printing is transmitted to the image forming apparatus 100, the image carrier 132 is uniformly charged by the charging device 148, and then a light beam corresponding to a black image is emitted from the exposure device 152 to the charged image carrier 132 based on the image signal. The surface of the image carrier 132 is exposed to the light beam emitted from the exposure device 152, so that an electrostatic latent image is formed thereon. In the case of the black-and-white printing, the controller 160 rotates the rotating plate 182 so that the developing roller 146K of the developing device 142K is driven, and applies a predetermined voltage (developing bias) to the developing roller 146K.

When the rotating plate 182 rotates so that the developing roller 146K of the developing device 142K is driven, the cam 204 rotates to bring the displacement forming portion 208*a* (or 208*b*) into contact with the arm portion 212 as also shown in FIG. 12C and displaces the first displacement member 186 and the second displacement member 188, so that the main transport path 122 is connected to the ejecting transport path 124.

The electrostatic latent image carried by the image carrier 132 is developed with a black developer supplied to the developing roller 146K of the developing device 142K to be transferred to the recording medium supplied from the paper feed unit 114 through the main transport path 122. The developer remaining on the image carrier 132 is scraped and recovered by the image carrier cleaner 150. The recording medium with the black developer image transferred thereto is guided to the fixing device 154, at which the black developer image is fixed onto the recording medium by the heating roller 156 and the pressure roller 158.

The recording medium with the black developer image fixed thereon is guided to the ejecting transport path 124 connected to the main transport path 122 to be guided into the eject roller 129. The eject roller 129 ejects the recording medium from the ejection port 128 to the ejector 113.

Next, the entire operation (color printing) of the image forming apparatus 100 will be described.

Figure 17:
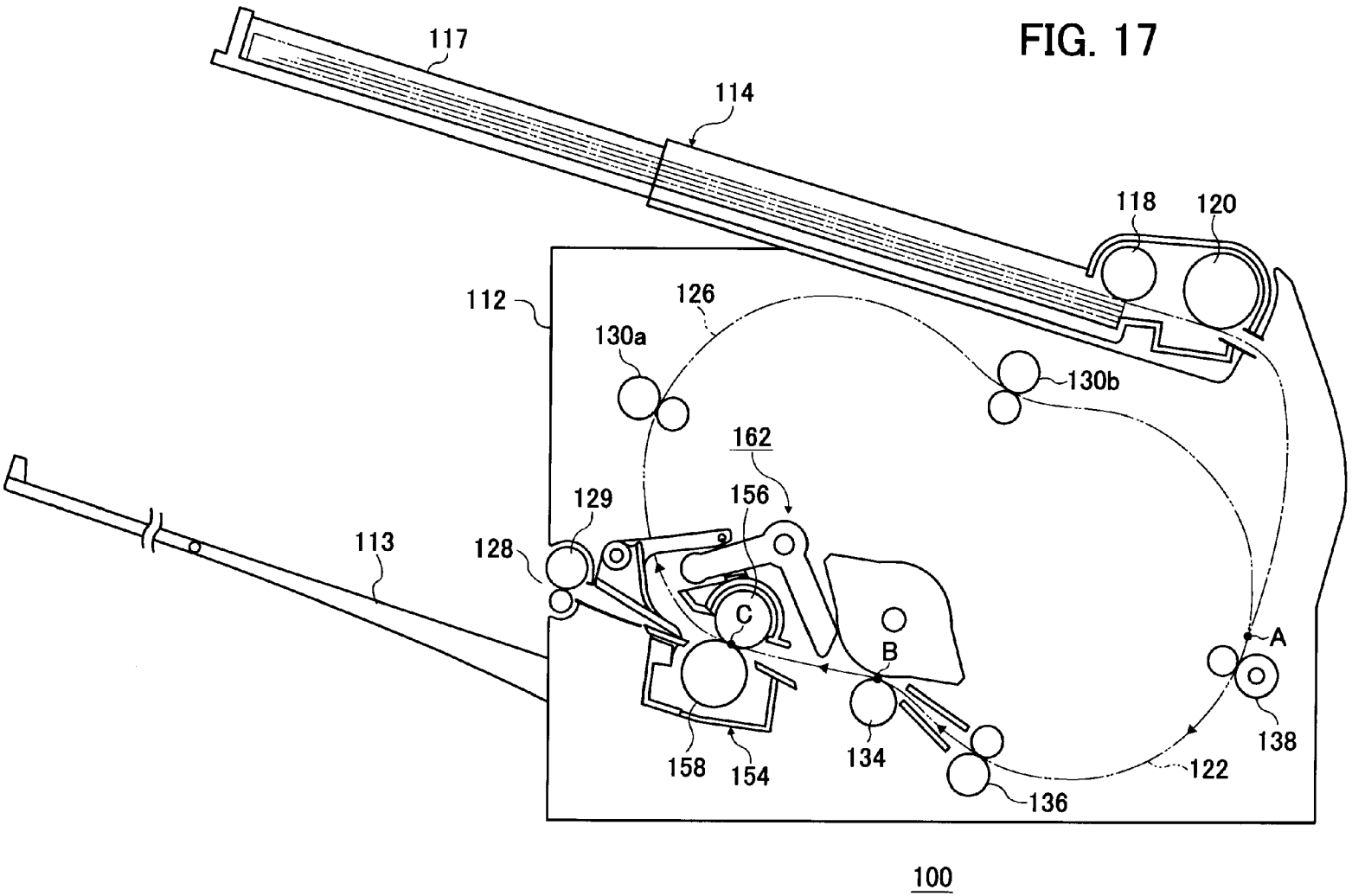
FIG. 17 is a side view illustrating the relationship between the switching mechanism for the image forming apparatus in yellow image printing, and the circulating transport path and the main transport path.

FIG. 17 is a side view illustrating the relationship between the switching mechanism 162 for the image forming apparatus 100 in yellow image printing, and the circulating transport path 126 and the main transport path 122.

When an image forming signal corresponding to color printing is transmitted to the image forming apparatus 100, the image carrier 132 is uniformly charged by the charging device 148, and then a light beam corresponding to a yellow image is emitted from the exposure device 152 to the charged image carrier 132 based on the image signal. The surface of the image carrier 132 is exposed to the light beam emitted from the exposure device 152, so that an electrostatic latent image is formed thereon. In the case of the color printing, the controller 160 rotates the rotating plate 182 so that, for example, the developing roller 146Y of the developing device 142Y is first driven, and applies a predetermined voltage (developing bias) to the developing roller 146Y.

When the rotating plate 182 rotates so that the developing roller 146Y of the developing device 142Y is driven, the cam 204 rotates to bring the cylindrical portion 206 into contact with the arm portion 212 as also shown in FIG. 13C and displaces the first displacement member 186 and the second displacement member 188, so that the main transport path 122 is connected to the circulating transport path 126.

The electrostatic latent image carried by the image carrier 132 is developed with a yellow developer supplied to the developing roller 146Y of the developing device 142Y to be transferred to the recording medium supplied from the paper feed unit 114 through the main transport path 122. The recording medium with the yellow developer image transferred thereto is guided to the fixing device 154, at which the yellow developer image is fixed onto the recording medium by the heating roller 156 and the pressure roller 158.

The recording medium with the yellow developer image fixed thereon is guided to the circulating transport path 126 connected to the main transport path 122 to be transported to the transfer position B through the merging point A into the main transport path 122, and the registration roller 136. The developer remaining on the image carrier 132 is scraped and recovered by the image carrier cleaner 150.

The image carrier 132 is uniformly charged again by the charging device 148, and then a light beam corresponding to a magenta image is emitted from the exposure device 152 to the charged image carrier 132 based on the image signal. The surface of the image carrier 132 is exposed to the light beam emitted from the exposure device 152, so that an electrostatic latent image is formed thereon.

The controller 160 rotates the rotating plate 182 so that the developing roller 146M of the developing device 142M is driven, and applies a predetermined voltage (developing bias) to the developing roller 146M.

When the rotating plate 182 rotates so that the developing roller 146M of the developing device 142M is driven, the cam 204 rotates with the cylindrical portion 206 brought into contact with the arm portion 212 as shown in FIG. 14C, so that the connection between the main transport path 122 and the circulating transport path 126 is maintained.

The electrostatic latent image carried by the image carrier 132 is developed with a magenta developer supplied to the developing roller 146M of the developing device 142M. The magenta developer image carried by the image carrier 132 is superimposed and transferred onto the recording medium with the yellow developer image transferred thereto. The recording medium with the magenta developer image transferred thereto is guided to the fixing device 154, at which the magenta developer image is fixed onto the recording medium by the heating roller 156 and the pressure roller 158.

The recording medium with the magenta developer image fixed thereon is guided to the circulating transport path 126 connected to the main transport path 122 to be transported to the transfer position B through the merging point A into the main transport path 122, and the registration roller 136. The developer remaining on the image carrier 132 is scraped and recovered by the image carrier cleaner 150.

The image carrier 132 is uniformly charged again by the charging device 148, and then a light beam corresponding to a cyan image is emitted from the exposure device 152 to the charged image carrier 132 based on the image signal. The surface of the image carrier 132 is exposed to the light beam emitted from the exposure device 152, so that an electrostatic latent image is formed thereon.

The controller 160 rotates the rotating plate 182 so that the developing roller 146C of the developing device 142C is driven, and applies a predetermined voltage (developing bias) to the developing roller 146C.

When the rotating plate 182 rotates so that the developing roller 146C of the developing device 142C is driven, the cam 204 rotates with the cylindrical portion 206 brought into contact with the arm portion 212 as shown in FIG. 15C, so that the connection between the main transport path 122 and the circulating transport path 126 is maintained.

The electrostatic latent image carried by the image carrier 132 is developed with a cyan developer supplied to the developing roller 146C of the developing device 142C. The cyan developer image carried by the image carrier 132 is further superimposed and transferred onto the recording medium with the magenta developer image transferred thereto. The recording medium with the cyan developer image transferred thereto is guided to the fixing device 154, at which the cyan developer image is fixed onto the recording medium by the heating roller 156 and the pressure roller 158.

The recording medium with the cyan developer image fixed thereon is guided to the circulating transport path 126 connected to the main transport path 122 to be transported to the transfer position B through the merging point A into the main transport path 122, and the registration roller 136. The developer remaining on the image carrier 132 is scraped and recovered by the image carrier cleaner 150.

The image carrier 132 is uniformly charged again by the charging device 148, and then a light beam corresponding to a black image is emitted from the exposure device 152 to the charged image carrier 132 based on the image signal. The surface of the image carrier 132 is exposed to the light beam emitted from the exposure device 152, so that an electrostatic latent image is formed thereon. The controller 160 rotates the rotating plate 182 so that the developing roller 146K of the developing device 142K is driven, and applies a predetermined voltage (developing bias) to the developing roller 146K.

When the rotating plate 182 rotates so that the developing roller 146K of the developing device 142K is driven, the cam 204 rotates to bring the displacement forming portion 208*a* (or 208*b*) into contact with the arm portion 212 as also shown in FIGS. 12C and 16 and displaces the first displacement member 186 and the second displacement member 188, so that the main transport path 122 is connected to the ejecting transport path 124.

The electrostatic latent image carried by the image carrier 132 is developed with a black developer supplied to the developing roller 146K of the developing device 142K to be transferred to the recording medium supplied from the paper feed unit 114 through the main transport path 122. The developer remaining on the image carrier 132 is scraped and recovered by the image carrier cleaner 150. The recording medium with the black developer image transferred thereto is guided to the fixing device 154, at which the black developer image is fixed onto the recording medium by the heating roller 156 and the pressure roller 158.

The recording medium with the black developer image fixed thereon is guided to the ejecting transport path 124 connected to the main transport path 122 to be guided into the eject roller 129. The eject roller 129 ejects the recording medium from the ejection port 128 to the ejector 113.

The above-described second exemplary embodiment is in terms of the present image forming apparatus in which there are provided the motor 196 for driving the rotating plate 182, and the motor 166 for driving the developing rollers 146Y, 146M, 146C, and 146K. However, the present image forming apparatus is not limited to this structure, and may have a structure in which the driving force of a single motor is transmitted to the rotating plate 182, and the developing rollers 146Y, 146M, 146C, and 146K.

While the first and second exemplary embodiments have been described with reference to the case where a monochrome image or a color image is formed using four color developing devices, i.e., yellow, magenta, cyan and black developing devices, the developing devices are not limited to these colors. For example, a red developing device, as a single color developing device, may be added, and the switching mechanism may operate in a single color mode and a multiple-color mode. Also, developing devices such as a light magenta developing device, a light cyan developing device and the like may be added for forming high-resolution and high-definition color images.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image carrier that carries an electrostatic latent image;

a plurality of developing devices that store respective developers of different colors and visualize the electrostatic latent image with the developers;

a developing device switching mechanism that switches among the developing devices to allow one of the developing devices to visualize the electrostatic latent image carried by the image carrier;

a transfer unit that transfers a developer image visualized by the one of the developing devices to a recording medium;

a fixing device that fixes the developer image transferred by the transfer unit onto the recording medium;

a first transporter that transports in a first direction the recording medium with the developer image fixed thereon by the fixing device;

a second transporter that transports in a second direction the recording medium with the developer image fixed thereon by the fixing device; and a transporter switching mechanism that switches between the first transporter and the second transporter in conjunction with an operation of the developing device switching mechanism for switching among the developing devices, the developing device switching mechanism mechanically actuating the transporter switching mechanism.

2. The image forming apparatus according to claim 1, wherein the developing device switching mechanism sequentially moves the plurality of developing devices to a developing position for switching among the developing devices.

3. The image forming apparatus according to claim 1, wherein the developing device switching mechanism sequentially drives the plurality of developing devices for switching among the developing devices.

4. The image forming apparatus according to claim 1, wherein the transporter switching mechanism switches to the first transporter for transporting the recording medium in conjunction with the operation of the developing device switching mechanism for switching among the plurality of developing devices for visualizing the electrostatic latent image with a predetermined one of the developing devices.

5. The image forming apparatus according to claim 4, wherein, when the transfer unit sequentially transfers developer images of respective colors to the recording medium, the developing device switching mechanism switches among the plurality of developing devices such that the electrostatic latent image is last visualized with a predetermined one of the developing devices.

6. The image forming apparatus according to claim 1, wherein the first transporter transports the recording medium with the developer image fixed thereon by the fixing device, in a direction to eject the recording medium, and the second transporter transports the recording medium with the developer image fixed thereon by the fixing device, to a transfer position to allow the transfer unit to transfer a developer image of a color other than the color of the developer image.

7. An image forming apparatus comprising:

an image carrier that carries an electrostatic latent image;

a plurality of developing devices that store respective developers of different colors and visualize the electrostatic latent image with the developers;

a developing device switching mechanism that switches among the developing devices to allow one of the developing devices to visualize the electrostatic latent image carried by the image carrier;

a transfer unit that transfers a developer image ,visualized by the one of the developing devices to a recording medium;

a fixing device that fixes the developer image transferred by the transfer unit onto the recording medium;

a first transporter that transports in a first direction the recording medium with the developer image fixed thereon by the fixing device;

a second transporter that transports in a second direction the recording medium with the developer image fixed thereon by the fixing device; and a transporter switching mechanism that includes a cam fixed to a shaft moving the plurality of developing devices, wherein the transporter switching mechanism switches between the first transporter and the second transporter according to the shaft sequentially moving the plurality of developing devices to a developing position and the cam is moved in conjunction with an operation of the developing device switching mechanism for switching among the developing devices.

* * * * *